US009051528B2

(12) United States Patent
Sinha et al.

(10) Patent No.: US 9,051,528 B2
(45) Date of Patent: Jun. 9, 2015

(54) SU-8 NANO-COMPOSITES WITH IMPROVED TRIBOLOGICAL AND MECHANICAL PROPERTIES

(71) Applicant: National University of Singapore, Singapore (SG)

(72) Inventors: Sujeet Kumar Sinha, Singapore (SG); Prabakaran Saravanan, Singapore (SG); Satyanarayana Nalam, Singapore (SG)

(73) Assignee: NATIONAL UNIVERSITY OF SINGAPORE, Singapore (SG)

( * ) Notice: Subject to any disclaimer, the term of this patent is extended or adjusted under 35 U.S.C. 154(b) by 36 days.

(21) Appl. No.: 13/683,467

(22) Filed: Nov. 21, 2012

(65) Prior Publication Data

US 2013/0130951 A1 May 23, 2013

Related U.S. Application Data

(60) Provisional application No. 61/563,522, filed on Nov. 23, 2011.

(51) Int. Cl.

| | |
|---|---|
| ***C10M 107/02*** | (2006.01) |
| ***C10M 107/00*** | (2006.01) |
| ***C10M 169/04*** | (2006.01) |

(52) U.S. Cl.

CPC ..... *C10M 7/00* (2013.01); *C10M 169/04* (2013.01); *C10M 2201/041* (2013.01); *C10M 2201/065* (2013.01); *C10M 2201/066* (2013.01); *C10M 2201/105* (2013.01); *C10M 2203/106* (2013.01); *C10M 2205/022* (2013.01); *C10M 2207/40* (2013.01); *C10M 2209/0845* (2013.01); *C10M 2209/103* (2013.01); *C10M 2213/06* (2013.01); *C10M 2213/062* (2013.01); *C10M 2229/0415* (2013.01); *C10N 2210/04* (2013.01); *C10N 2210/06* (2013.01); *C10N 2220/082* (2013.01); *C10N 2230/06* (2013.01); *C10N 2240/06* (2013.01)

(58) Field of Classification Search

None

See application file for complete search history.

(56) References Cited

PUBLICATIONS

Puukilainen et al. J. Applied Polym. Sci., 2007, 104, 1762-1768.*

Eicke "Interfacial Phenomena in Apolar Media," CRC Press, Nov. 1986, p. 31.*

Rouzaud et al. @ http://www.acs.omnibooksonline.com/data/papers/2004_C052.pdf, downloaded Jul. 24, 2014.*

(Continued)

*Primary Examiner* — Vu A Nguyen

(74) *Attorney, Agent, or Firm* — Hultquist, PLLC; Steven J. Hulquist

(57) ABSTRACT

Substantially homogenous compositions in accordance with the present disclosure can exist in various forms, such as bulk materials, coatings, films, laminates, inserts, or overlays, and include at least one polymer such as SU-8, at least one liquid lubricant, and optionally at least one nanomaterial that serves as an inorganic filler material. Such compositions exhibit enhanced tribological and mechanical properties compared to the at least one polymer in isolation, for instance, a 50% or greater coefficient of friction reduction, a 100% or greater wear life increase, a 10% or greater elastic modulus increase, and/or a 10% or greater hardness increase. The at least one nanomaterial can include a first nanomaterial providing increased hardness, and a second nanomaterial providing increased elastic modulus. Compositions in accordance with the present disclosure are suitable for biological and non-biological applications.

18 Claims, 14 Drawing Sheets

(56) References Cited

PUBLICATIONS

Abgrall, P., et al., "SU-8 as a structural material for labs-on-chips and microelectromechanical systems", "Electrophoresis", 2007, pp. 4539-4551, vol. 28.
Ahn, H., et al., "Dramatic enhancement of wear stability in oil-enriched polymer gel nanolayers", "Wear", 2003, pp. 801-807, vol. 255.
Asay, D., et al., "In-situ Vapor-Phase Lubrication of MEMS", "Tribology Letters", Nov. 27, 2007, pp. 67-74, vol. 29.
Asay, D., et al., "Macro- to Nanoscale Wear Prevention via Molecular Adsorption", "Langmuir", Nov. 29, 2007, pp. 155-159, vol. 24.
Chiamori, H., et al., "Suspension of nanoparticles in SU-8: Processing and characterization of nanocomposite polymers", "Microelectronics Journal", Aug. 2, 2007, pp. 228-236, vol. 39.
Conradie, E., et al., "SU-8 thick photoresist processing as a functional material for MEMS applications", "J. Micromech. Microeng.", Jun. 13, 2002, pp. 368-374, vol. 12.
De Boer, M., et al., "Tribology of MEMS", "MRS Bulletin", Apr. 2001, pp. 302-304.
Eapen, K., et al., "MEMS Lubricants Based on Bound and Mobile Phases of Hydrocarbon Compounds: Film Deposition and Performance Evaluation", "Journal of Micoreletromechanical Systems", Oct. 2005, pp. 954-960, vol. 14, No. 5.
Henck, S., "Lubrication of digital micromirror devices", "Tribology Letters", 1997, pp. 239-247, vol. 3.
Jiguet, S., et al., "SU-8 nanocomposite photoresist with low stress properties for microfabrication applications", "Microelectronic Engineering", Mar. 15, 2006, pp. 1966-1970, vol. 83.
Jiguet, S., et al., "Effect of filler behavior on nanocomposite SU8 photoresist for moving micro-parts", "Microelectronic Engineering", Feb. 9, 2006, pp. 1273-1276, vol. 83.
Julthongpiput, D., et al., "Towards self-lubricated nanocoatings", "Tribology International", 2002, pp. 829-836, vol. 35.
Julthongpiput, D., et al., "Tribological behavior of grafted polymer gel nanocoatings", "Tribology Letters", Jul. 2002, pp. 35-40, vol. 13, No. 1.
Kim, S., et al., "Nanotribology and MEMS", "nanotoday", Oct. 2007, pp. 22-29, vol. 2, No. 2.
Knieling, T., et al., "Gas phase hydrophobisation of MEMS silicon structures with self-assembling monolayers for avoiding in-use sticking", "Sensors and Actuators B", Nov. 28, 2006, pp. 13-17, vol. 126.
Lee, K., et al., "Nanotribological characterization of fluoropolymer thin films for biomedical micro/nanoelectromechanical system applications", "J. Vac. Sci. Technol. A", Jun. 24, 2005, pp. 804-810, vol. 23, No. 4.
Marinis, T., "The Future of Microelectromechanical systems (MEMS)", "Strain", 2009, pp. 208-220, vol. 45.
Mionic, M., et al., "Preparation and characterization of SU8-carbon nanotube composites", "Phys. Status Solidi B", Nov. 20, 2009, pp. 2461-2464, vol. 246, No. 11-12.
Mionic, M., et al., "Study of the mechanical response of carbon nanotubes-SU8 composites by nanoindentation", "Phys. Status Solidi B", Sep. 13, 2010, pp. 3072-3075, vol. 247, No. 11-12.
Patton, S., et al., "Lubrication of microelectromechanical systems radio frequency switch contacts using self-assembled monolayers", "J. Appl. Phys.", Jul. 17, 2007, pp. 1-5, vol. 102, No. 024903.
Patton, S., et al., "Bimetallic nanoparticles for surface modification and lubrication of MEMS switch contacts", "Nanotechnology", Jul. 30, 2008, pp. 1-6, vol. 19, No. 405705.
Prasad, S., et al., "Application of Diamond-Like Nanocomposite Tribological Coatings on LIGA Microsystem Parts", "Journal of Microeletromechanical Systems", Jun. 2009, pp. 695-704, vol. 18, No. 3.
Puukilainen, E., et al., "Modification of Surface Properties of Polyethylene by Perfluoropolyether Blending", "Journal of Polymer Science: Part B: Polymer Physics", 2005, pp. 2252-2258, vol. 43.
Puukilainen, E., et al., "Nanostructured and chemically modified hydrophobic polyolefin surfaces", "Colloids and Surfaces A: Physicochem. Eng. Aspects", Apr. 15, 2006, pp. 175-181, vol. 287.
Puukilainen, E., et al., "Compression-Molded, Lubricant-Treated UHMWPE Composites", "Journal of Applied Polymer Science", 2006, pp. 1762-1768, vol. 104.
Satyanarayana, N., et al., "Tribology of PFPE overcoated self-assembled monolayers deposited on Si surface", "J. Phys. D: Appl. Phys.", Sep. 2, 2005, pp. 3512-3522, vol. 38.
Satyanarayana, N., et al., "Highly wear resistant chemisorbed polar ultra-high-molecular-weight polyethylene thin film on Si surface for micro-system applications", "J. Mater. Res.", Nov. 2009, pp. 3331-3337, vol. 24, No. 11.
Scharf, T., et al., "Growth, structure, and tribological behavior of atomic layer-deposited tungsten disulphide solid lubricant coatings with applications to MEMS", "Acta Materialia", Sep. 7, 2006, pp. 4731-4743, vol. 54.
Sidorenko, A., et al., "Oily nanocoatings", "Tribology Letters", Feb. 2002, pp. 101-104, vol. 12, No. 2.
Sidorenko, A., et al., "Wear stability of polymer nanocomposite coatings with trilayer architecture", "Wear", 2002, pp. 946-955, vol. 252.
Singh, R., et al., "Tribo-functionalizing Si and SU8 materials by surface modification for application in MEMS/NEMS actuator-based devices", "J. Phys. D: Appl. Phys.", Dec. 9, 2010, pp. 1-10, vol. 44, No. 015301.
Singh, R., et al., "Surface chemical modification for exceptional wear life of MEMS materials", "AIP Advances", Nov. 4, 2011, pp. 1-8, vol. 1, No. 042141.
Voigt, A., et al., "Improved properties of epoxy nanocomposites for specific applications in the field of MEMS/NEMS", "Microelectronic Engineering", Jan. 27, 2007, pp. 1075-1079, vol. 84.
Ma, J., et al., "Preparation and tribological properties of multiply-alkylated cyclopentane (MAC)-octadecyltrichlorosilane (OTS) double-layer film on silicon", "Wear", May 23, 2007, pp. 1000-1007, vol. 263.

* cited by examiner

| Test and Nanocomposite Comparison No of sliding cycles at which image captured | | Ball Image | Ball Image after Cleaning | Surface Image |
|---|---|---|---|---|
| 300g,500 rpm test on bare substrates without any lubricant | Bare Si (40000) |   |   |   |
| | Bare Steel (40000) |   |   |   |
| | Bare Aluminum (40000) |   |   |  |

| Test and Nanocomposite Comparison No of sliding cycles at which image captured | | Ball Image | Ball Image after Cleaning | Surface Image |
|---|---|---|---|---|
| 300g, 2000rpm, SU-8+PFPE Free Standing Lub-tape Film | SU-8+PFPE Lub-tape Film - High friction Side – 10wt% (500000) |   |   |   |
| 300g, 1000 rpm, SU-8+PFPE Free Standing Lub-tape Film | SU-8+PFPE Lub-tape Film - Low friction Side – 10wt% (500000) |   |   |   |
| | SU-8+PFPE Lub-tape Film - Low friction Side – 5wt% (500000) |   |   |   |

SU-8 NANO-COMPOSITES WITH IMPROVED TRIBOLOGICAL AND MECHANICAL PROPERTIES

CROSS REFERENCE TO RELATED APPLICATIONS

This application claims benefit under 35 USC 119 of U.S. Provisional Patent Application Ser. No. 61/563,522, entitled "SU-8 Nano-Composites with Improved Tribological and Mechanical Properties," filed on 23 Nov. 2011, which is incorporated herein by reference in its entirety.

TECHNICAL FIELD

Various embodiments of present disclosure are directed to self-lubricating polymer materials providing desirable, improved, or significantly enhanced tribological and mechanical properties. In multiple embodiments, such materials include one or more types of photosensitive or non-photosensitive polymers (e.g., SU-8, KMPR, or JSR THB 151N photoresist; polymethylmethacrylate (PMMA), polydimethylsiloxane (PDMS); or another material) that are combined or mixed (e.g., homogeneously blended) with a liquid lubricant (e.g., a perfluoropolyether (PFPE) and/or other lubricant); and optionally one or more types of nanoparticles or nanostructures (e.g., Carbon nanotubes (CNTs), $SiO_2$ nanoparticles, Graphite nanoparticles, and/or other types of nanoparticles). Particular embodiments in accordance with the present disclosure are directed to low friction, mechanically robust materials that can (1) be patterned to form microstructures or nanostructures in association with the fabrication of microelectromechanical (MEMS) or nanoelectromechanical (NEMS) components or devices; (2) provide a solid lubricant for sliding/moving/semi-moving/physically couplable non-biological or biological structures or interfaces; and/or (3) form a portion or surface of a lubricating tape ("Lub-tape") that can be selectively or preferentially applied to a variety of structures or interfaces, e.g., to reduce friction.

BACKGROUND

MEMS are miniaturized devices consisting of one or more micro machined components or structures. These devices are usually fabricated through the integration of several components with diversified functions such as mechanical, electrical, magnetic, biological etc. . . . functions. In the past two decades, many MEMS devices have been successfully put into applications, although the majority of MEMS devices are still under research or investigation. MEMS device research and development is rapidly emerging, and now extends to nearly every industrial field including automotive, bio-engineering/biomedical, telecommunications, electronics, space, military and gaming industries, etc. . . . [Marinis 2009].

In general, despite ongoing research and development activities, the reliability of MEMS devices needs significant improvement. One of the major issues limiting the reliability of MEMS devices is tribology, specifically friction, adhesion and wear. If two non-lubricated MEMS surfaces come into contact, they show high adhesion force, high friction and eventually lead to wear (loss of material). Hence, if these tribological issues are not addressed properly, they limit the operating life of MEMS devices and eventually their reliability [Kim et al 2007].

As the size of the MEMS devices is measured in micrometers (or sub-millimeters), the surface-to-volume ratio is very high when compared to the gravity and inertial forces, and hence surface forces such as van der Waals, capillary, electrostatic, and chemical forces play an important role in device performance. Hence, in these devices, the tribological and the interfacial forces are comparable to or higher than the forces causing device motion. Hence, there is a great need for the solutions which address tribological issues in MEMS devices.

The mainstay structural material from which MEMS devices are made has been Si, particularly as a result of the mature Si material fabrication capabilities (arising from integrated circuit/microchip industry) at the micro-meter scale. However, Si does not have good tribological properties and it shows high friction, adhesion force and wear, respectively, when sliding against itself or any other material. Therefore, thorough research was conducted over the past two decades in an effort to improve the tribological properties of Si. Because of the small length scales of MEMS devices, macro scale oil based lubrication methods are not applicable and hence researchers have developed certain specific types of nanometer to sub-micrometer thick films (mostly solid lubricants) which reduce friction, adhesion force and wear, respectively. These thin films include self-assembled monolayers (SAMs), polymer coatings, vapor deposited organic layers, fluorine based organic layers, solid coatings etc [Patton et al 2007 & 2008; Knieling et al 2007; Henck 1997; Satyanarayana and Sinha 2005; Eapen et al 2005; Ma et al 2007; Sidorenko et al 2002 (a); Satyanarayana et al 2009; Asay et al 2008 (a) & (b); Lee et al 2005; Prasad et al 2009 and Scharf et al 2006]. Though Si has several advantages, it has certain inherent drawbacks such as brittleness, high friction and adhesion force, non-biocompatibility etc. . . . Therefore, recently, SU-8 has been replacing Si for certain applications [Abgrall et al 2007].

SU-8 polymer is an epoxy-type UV-sensitive negative photoresist material which is used as a photoresist as well as a structural material in the fabrication of MEMS. SU-8 has several advantages such as ease of fabrication, hydrophobic nature, high thermal stability, good chemical resistance and biocompatibility which makes it an attractive material from which to fabricate MEMS devices. Despite its advantages, SU-8 has some disadvantages such as poor mechanical and tribological properties, respectively, and high internal stresses which limit its use as a structural material for fabricating reliable MEMS structures with complex designs and multiple functions.

Jiguet et al [2006 (a) & (b)] have studied the effect of the addition of silica nanoparticles (diameter: 13 nm and concentration: 5 wt %) to SU-8, and the effect of thermal treatment on the friction and the wear properties of SU-8. Sliding tests were conducted against steel and POM (polyoxymethylene) balls. The SU-8 nanocomposites reduced wear rates and friction coefficients marginally when compared to the un-reinforced SU-8. The improvement was very minimal when compared to the stringent property requirements of MEMS devices in terms of their reliability, longer operating life time and accuracy. This study has also deduced that the coefficient of friction of the composites depends on the counterface material and the elastic properties of the SU-8 material. This study has also shown that heat treatment can considerably reduce the wear rate of reinforced and un-reinforced materials.

Singh et al [2011 (a)] have developed a two-step SU-8 surface modification method (i.e., modification of an outer surface of an SU-8 structure) which has improved the tribological properties of SU-8 film surfaces by several fold. The two-step surface modification consists of first treating an SU-8 film surface with oxygen plasma, followed by the application of a nanolubricant such as PFPE. By the application of the two-step surface modification method to SU-8 thin (thickness: 500 nm) and thick films (thickness: 50 μm) on Si surfaces, the initial coefficient of friction has been reduced by ~4-7 times, the steady-state coefficient of friction has been reduced by ~2.5-3.5 times and the wear durability has been increased by >1000 times. The authors have done the tribological tests under the loading conditions of a normal load of 150 g and a rotational speed of 200 rpm. The two-step surface modification method has slightly reduced the elastic modulus and hardness of pristine SU-8 thick films, as observed in nanoindentation tests.

Singh et al [2011 (b)] have also developed a two-step SU-8 chemical modification method (i.e. modification of an outer surface of an SU-8 structure) which has improved the tribological properties of SU-8 film surfaces by several fold. The two-step chemical modification method consists of first chemically treating an SU-8 film using ethanolamine-sodium phosphate buffer, followed by the coating of PFPE nanolubricant. By the application of the two-step chemical modification method to SU-8 thin (thickness: 500 nm) and thick films (thickness: 50 μm) on Si surfaces, the steady-state coefficient of friction has been reduced by ~4-5 times and the wear durability has been increased by >1000 times. The authors have done the tribological tests under the loading conditions of a normal load of 150 g and a rotational speed of 200 rpm. The authors have attributed the significant reduction in the friction coefficients to the lubrication effect of PFPE nanolubricant, while the exceptional increase in their wear life was attributed to the bonding between the —OH functional groups of ethanolamine treated SU-8 thin/thick films and the —OH functional groups of PFPE.

Voigt et al [2007] have demonstrated the miscibility of epoxy resin surface-modified $SiO_2$ nanoparticles (average particle diameter: 20 nm) into epoxy photomaterial to create a photo-patternable material with improved lithographic, optical and mechanical properties. The addition of the epoxy resin surface-modified $SiO_2$ nanoparticles to epoxy resin has increased the Young's modulus as observed in the nanoindentation tests and it was observed that the Young's modulus has increased with the content of the $SiO_2$ particles. For the highest silica content added, the Young's modulus has increased from 5.8 GPa to 8.7 GPa.

Chiamori et al [2008] have investigated the mechanical properties of SU-8 composite materials added with diamondoids and SWCNTs (single-walled carbon nanotubes) (average diameter: 0.8 nm and concentration: 1 wt % and 5 wt %). Uniaxial tensile tests were conducted on nanocomposite samples using a MTS Bionix 200 tensile tester and the effective elastic modulus was extracted from the force-displacement curves and geometry of the samples. SU-8 has shown an elastic modulus of 1.6 GPa whereas the diamondoid and SWCNTs added SU-8 has shown elastic modulus values of 1.9 GPa and 1.3 GPa, respectively. In their study, the addition of the nanoparticles did not show any significant improvement in the mechanical properties of SU-8 (SWCNTs have in fact slightly reduced the elastic modulus of SU-8).

Mionic et al [2010] have fabricated SU-8+MWCNT (multiwalled carbon nanotubes) (concentration: 5 wt %) composites and measured their mechanical properties using nanoindentation. They have also studied the influence of SU-8 solvent on the structural homogeneity and mechanical properties of the composites. They have observed that the solvent type and the functionalization of MWCNTs affect the Young's modulus of the composites. In their study, a highest increase of the Young's modulus of 104% in respect to the parent material was observed when acetone was used as the solvent.

From the above studies it is clear that researchers have developed different strategies in their attempts to improve either tribological properties or mechanical properties of SU-8. That is, the above studies have demonstrated independent improvement in tribological properties of SU-8, without improvement in mechanical properties of SU-8; or independent improvement in the mechanical properties of SU-8, without improvement in tribological properties of SU-8.

Liquid lubricants have been added to certain polymer nanolayers [Julthongpiput et al 2002 (a) and (b), Sidorenko et al 2002 (b) and Ahn et al 2003] and also to other polymers such as high density polyethylene (HDPE), polyolefin and ultra-high-molecular weight polyethylene (UHMWPE) [Puukilainen et al 2005, 2006, 2007]. In research works conducted by Tsukruk and co-workers [Julthongpiput et al 2002 (a) and (b), Sidorenko et al 2002 (b) and Ahn et al 2003], paraffin oil ($C_{15}H_{32}$—$C_{24}H_{50}$) was added into a polymer nanolayer of poly[styrene-b-(ethylene-co-butylene)-b-styrene] (SEBS), and the enrichment of paraffin oil into the polymer nanolayers improved wear durability. Whereas, in the research works conducted by Puukilainen and co-workers [Puukilainen et al 2005, 2006, 2007], they have blended PFPE into polymers such as HDPE, polyolefin and UHMWPE and the blending of PFPE into these polymers has improved hydrophobic property and the tribological properties (i.e., lowered the coefficient of friction and increased abrasion resistance).

A need clearly exists for a manner of simultaneously improving the tribological and mechanical properties of SU-8 or other materials that can be used to produce MEMS components or devices.

SUMMARY

In accordance with an aspect of the present disclosure, a hybrid polymer composition, material, or structure (also referred to herein as a hybrid polymer nanocomposite) includes (a) at least one polymer such as SU-8, KMPR, JSR THB 151N, PMMA, or PDMS; (b) at least one liquid lubricant such as PFPE, mineral oil, base oil, multiply alkylated cyclopentane (MAC) lubricant, or a plant-based oil such as a vegetable oil; and optionally (c) at least one inorganic filler material such as CNTs, $SiO_2$, graphite, and/or other particles, where the at least one polymer, the at least one liquid lubricant, and the at least one inorganic filler material are distributed relative to each other within the composition in a substantially homogeneous manner. The PFPE and/or other lubricant(s) are included for the purpose of improving tribological properties, and the inorganic filler material(s), if present, such as CNTs, $SiO_2$ and graphite particles are included to improve mechanical properties. Compared to SU-8 by itself or in isolation, such SU-8 hybrid polymer compositions have reduced the coefficient of friction of SU-8 by ~6 times, improved the wear life by >2000 times, improved the elastic modulus and the hardness by ~1.4 times, respectively.

In accordance with related aspects of the present disclosure, a process for producing or manufacturing a hybrid polymer composition includes combining the polymer(s), the liquid lubricant(s), and the optional nanomaterial(s) to form a homogeneous or substantially homogeneous mixture (e.g., which can exist in a substantially liquid form prior to one or more curing or partial curing procedures); and a process for producing or manufacturing a device, component, or element that includes a hybrid polymer nanocomposite involves producing a set of partially or fully cured hybrid polymer nanocomposite layers, and forming micrometer and/or nanometer scale features, structures, or patterns in such layers.

In accordance with a further aspect of the present disclosure, a polymer—liquid lubricant layer, coating, or film, such as an SU-8+PFPE coating, can be formed using a coating or deposition technique such as spin-coating or simple dip-coating, onto different substrates such as Si, glass, steel, stainless steel or aluminum. On all these substrate materials, SU-8+PFPE coating has improved the tribological properties by several orders.

In accordance with yet another aspect of the present disclosure, a film and/or laminate structure, such as a self-contained, isolatable/isolated, or stand-alone film, that includes a hybrid polymer film (e.g., an SU-8 nanocomposite film) can be used to form a lubricating interface or tape for mechanical components where improved tribological properties are desired. Such a film or laminate structure can be selectively disposed or positioned (e.g., adhered) as a counterface material relative to particular structural components, elements, or features.

DESCRIPTION

Figure 1:
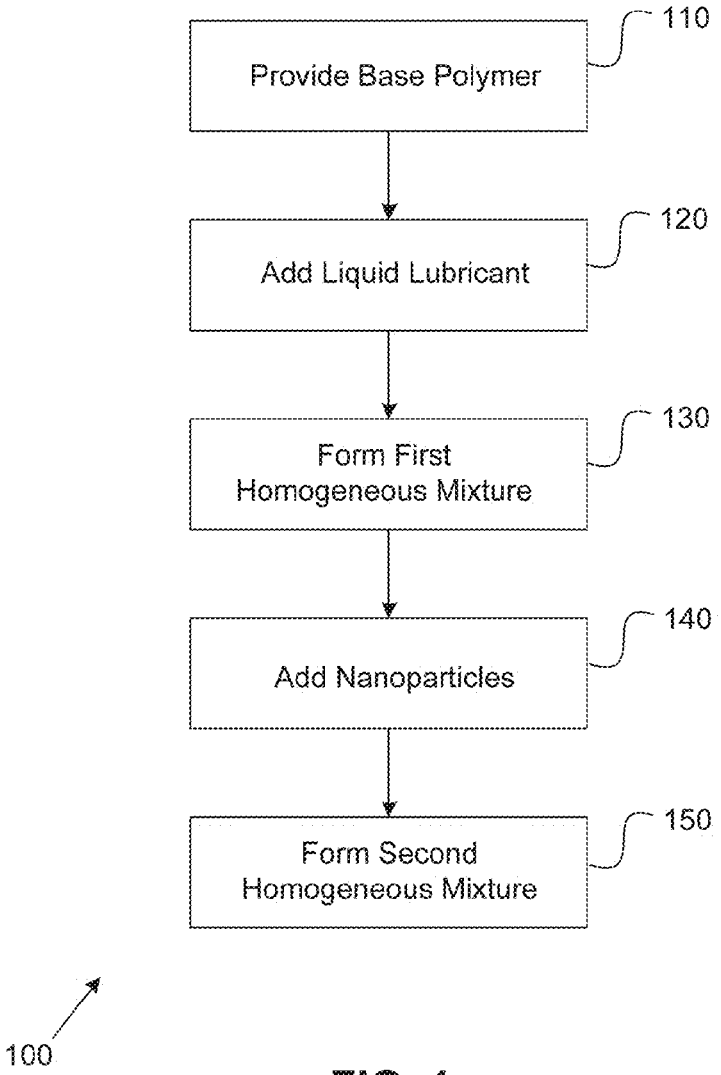
FIG. 1: Representative process for preparing or manufacturing a homogeneous composition including a base or reference polymer, a liquid lubricant, and optionally nanoparticles in accordance with an embodiment of the present disclosure.

Various embodiments in accordance with the present disclosure are directed to a homogeneous, substantially homogeneous, or generally homogeneous composition that includes the following:

(1) at least one polymer, where the at least one polymer can include a photosensitive or non-photosensitive polymer (e.g., SU-8, KMPR, or JSR THB 151N photoresist; PMMA; PDMS; or another material), which can be referred to or defined as a base or reference polymer or material;

(2) at least one liquid lubricant (e.g., PFPE, mineral oil, base oil, multiply alkylated cyclopentane (MAC) lubricant, a plant-based oil such as a vegetable oil, or another liquid lubricant); and (3) optionally, one or more types of nanomaterials, nanoparticles, nanostructures (e.g., nanospheres or nanotubes) corresponding to one or more types of materials, for instance, one or more forms of Carbon (e.g., graphite, graphene, or a fullerene such as Carbon 60 (C60)), $SiO_2$, $MoS_2$, $WS_2$, $TiO_2$, Ultra High Molecular Weight Polyethylene (UHMWPE), Polytetrafluoroethylene (PTFE), Polyether ether ketone (PEEK), a metamaterial, or another substance, from which a wide variety of assemblies, structures, elements, devices (e.g., MEMS and/or NEMS components) and/or physical media, laminates, or membranes that carry or include self-lubricating counterface materials, layers, or structures having simultaneously enhanced tribological and mechanical properties can be fabricated.

Compositions in accordance with various embodiments of the present disclosure can include approximately 70%-99.5% base polymer(s) (e.g., approximately 80%-99.9%, or about 95% base polymer); approximately 0.1%-29.5% liquid lubricant(s) (e.g., about 1%-20%, or about 2%-8%, or about 5% liquid lubricant); and possibly/optionally approximately 0.4%-29.9% nanomaterial(s) (e.g., about 1%-20%, or about 5%-15%, or about 10% nanomaterials), where such percentages can be weight percentages, and where such percentages are selectable or adjustable to yield a 100% composition in a manner readily understood by one of ordinary skill in the relevant art.

A composition in accordance with the present disclosure exhibits enhanced tribological and mechanical properties compared to the composition's polymer(s) considered in isolation. Depending upon embodiment details, compositions in accordance with the present disclosure can reduce a coefficient of friction by at least approximately 50%; increase wear life by at least approximately 100%, and in various embodiments at least approximately an order of magnitude; increase elastic modulus by at least approximately 5%-10%; and/or increase hardness by at least approximately 5%-10% relative to the composition's polymer(s) considered by themselves or in isolation. The selection of a given percentage of base polymer(s), liquid lubricant(s), and/or optional nanomaterial(s) within a composition in accordance with the present disclosure, and correspondingly the composition's resulting tribological and/or mechanical properties, can be based upon tribological, mechanical, spatial/volumetric, and/or other requirements or specifications associated with a surface or environment in which a composition in accordance with the present disclosure is intended to be used.

Compositions in accordance with the present disclosure can exist in various forms, such as bulk materials, coatings, films, laminates, inserts, or overlays. Furthermore, compositions in accordance with the present disclosure can provide or form assemblies, structures, devices, components, elements, or interfaces having enhanced or dramatically enhanced tribological and/or mechanical properties relative to a very wide range of non-biological applications (e.g., involving sliding, moving, or physically couplable mechanical surfaces, interfaces, or components) and biological applications (e.g., involving medical devices or instruments such as catheters, stents, tubes, needles, syringes, knives, etc. . . . for which reduction or minimization of friction and adhesion between the medical device or instrument and bodily tissue is desired or required).

Some specific non-limiting examples of MEMS applications in which compositions in accordance with the present disclosure can be used or incorporated to simultaneously enhance the tribological and mechanical properties of MEMS structures, components, or devices include RF MEMS switches, MEMS micro engines/motors, MEMS stages, MEMS watches, micro-gears, micro-shutters, micro-mirrors etc. An individual of ordinary skill in the relevant art will understand that compositions in accordance with embodiments of the present disclosure can also be used to enhance tribological and/or mechanical properties, and in various embodiments simultaneously enhance both tribological and mechanical properties in MEMS, NEMS, and/or other types of structures, components, devices, or media.

In some embodiments, compositions in accordance with the present disclosure can be carried by, incorporated into or onto, or form a portion of a load/unload ramp material or structure in data storage devices such as hard disk drives. More particularly, in recent years, a dynamic ramp load/unload technique has replaced the conventional contact-based start/stop technique in desktop and server had disk drives. This ramp load/unload technique has led to a new tribological interface between a ramp structure and a suspension element. Friction between the ramp structure and the suspension element plays an important role in hard disk drive reliability. For adequate or maximum hard disk drive reliability, this new tribological interface requires extremely low friction and minimum or essentially no wear particle generation. Hard disk drive ramp materials or structures can include one or more compositions in accordance with embodiments of the present disclosure (e.g., an SU-8 based composition in accordance with the present disclosure can be used as a hard disk drive ramp material), thereby meeting or exceeding such friction and wear particle generation requirements.

FIG. 1 is a flow diagram of a representative process 100 for preparing or manufacturing a homogeneous base polymer/liquid lubricant/nanoparticle composition according to an embodiment of the disclosure. In an embodiment, the process 100 includes a first process portion 110 involving providing a measured or predetermined quantity (e.g., approximately 90% by weight) of base polymer; a second process portion 120 involving adding a measured or predetermined quantity (e.g., approximately 5% by weight) of liquid lubricant; a third process portion 130 involving mixing, blending, or stirring the base polymer and the liquid lubricant to provide a homogeneous base polymer/liquid lubricant mixture (e.g., a first homogeneous mixture); an optional fourth process portion 140 involving adding a measured or predetermined quantity (e.g., approximately 5% by weight) of nanoparticles or nanostructures; and a correspondingly optional fifth process portion 150 involving mixing, blending, or stirring the homogeneous base polymer/liquid lubricant mixture with the nanoparticles or nanostructures to provide a homogeneous based polymer/liquid lubricant/nanoparticle composition (e.g., a second homogeneous mixture).

Depending upon embodiment details, the order of formation of the first and second homogeneous mixtures can be reversed. Additionally, mixing or blending can involve manual and/or automatic mixing techniques. Moreover, liquid lubricant(s) and nanoparticles can be added to the base polymer in separate process portions as indicated above, or simultaneously or substantially simultaneously. Furthermore, mixing, blending, or stifling can be accompanied by the application of heat for a given or predetermined period of time. For instance, forming a homogeneous mixture of an SU-8 base polymer and a PFPE lubricant can involve magnetic stifling at approximately 70 degrees C. for about 1-2 hours. A stirring technique, duration, and/or temperature can be selected in a manner that avoids under-stirring (which can lead to inhomogeneity, the presence of air pockets in a coated layer, or improper bonding between the composition and a substrate) and over-stirring (which can lead to partial solvent evaporation, internal curing, non-uniform composition distribution or dispersion over a substrate, and/or fibrous structure formation). During a mixing process, materials properties or characteristics can be monitored manually (e.g., visually) or automatically (e.g., by measuring optical properties) on a periodic, regular, or essentially continuous basis. Following the preparation or manufacture of a composition in accordance with the present disclosure, the composition can be applied to a substrate (e.g., via spin or dip coating) within a recommended or predetermined time period, or essentially immediately to avoid internal curing.

In accordance with a particular aspect of the present disclosure, a hybrid nanocomposite material or composition that includes SU-8 (also referred to herein as an "SU-8 based hybrid nanocomposite" or "SU-8 nanocomposite") is provided which includes SU-8, PFPE lubricant, and nanoparticles corresponding to $SiO_2$, CNTs and/or Graphite. SU-8 based hybrid nanocomposites in accordance with embodiments of the present disclosure have simultaneously reduced the coefficient of friction of SU-8 by ~6 times, improved wear life by >2000 times, and improved the elastic modulus and hardness by ~1.4 times, respectively. SU-8 nanocomposites in accordance with embodiments of the disclosure can be used as a self-lubricating structural material for MEMS or other types of structures, components, devices, or media where contacting surfaces are present, and hence self-lubricating SU-8 nanocomposites in accordance with embodiments of the disclosure can minimize or eliminate the need for external, extrinsic, or non-native lubrication. It will be appreciated by a person of ordinary skill in the relevant art that several components, processes, material applications or alternatives thereof in accordance with aspects of the present disclosure can be desirably combined into other or different components, processes, and/or material applications.

MEMS or other types of components where improved tribological properties are desired or required can be made using SU-8 nanocomposites in accordance with embodiments of the present disclosure, for instance, where no or essentially no need for external lubrication exists. Depending on the specific objectives or requirements of a MEMS or other application under consideration, a selected nanostructure or nanoparticle filler material can be combined, mixed, or blended with or added to SU-8 along with PFPE such that improved, significantly improved, or dramatically enhanced (1) lubricity as well as (2) mechanical and possibly other desired or required properties can be synergistically provided or achieved.

In accordance with another particular aspect of the present disclosure, SU-8+liquid lubricant (e.g., SU-8+PFPE) based nanocomposite films can be carried by or fabricated on different types of carriers, support members, or substrates. For instance, SU-8 nanocomposite films were fabricated on Si, glass, steel, stainless steel, and aluminum by way of dip-coating, and their tribological properties were evaluated. The SU-8+PFPE composite film on all the above substrates have shown significant improvement in tribological properties when compared to the bare substrate.

As SU-8+PFPE based films can be applied onto essentially any type of surface with simple dip coating, such a composite material can be used for essentially any type of mechanical component where improved tribological properties are desired or needed. Some specific non-limiting examples include gears, cams, piston, pivots, seals, couplings, engine, guides, bearings, shafts etc. . . . .

In addition or as an alternative to the foregoing, embodiments of the present disclosure can accommodate or include base or reference polymer substitution, variation, or modification. For instance, SU-8 material is available in different grades, and particular desired or required application objectives or requirements can influence or determine the respective grade of SU-8 to be used. For instance, SU-8 2050 has been used for spin coating experiments, and SU-8 2005 has been used for dip coating experiments. Alternatively, other SU-8 based materials, or another type of photoresist material such as KMPR (MicroChem Corp., Newton, Mass.) or JSR THB 151N (JSR Micro, Inc., Sunnyvale, Calif.), can be used to achieve essentially identical, similar, or analogous results.

In representative embodiments, PFPE Z-dol 4000 can be added to SU-8 as a liquid lubricant filler material to improve tribological properties. Other alternatives to PFPE Z-dol 4000, such as multiply alkylated cyclopentane (MAC), ionic liquid, pennzane, low cost base oils etc. . . . , can be used and substantially identical, similar, or analogous improvements in tribological properties can be achieved.

In various embodiments, one or more of $SiO_2$, CNT and graphite particles can optionally be added to SU-8 as a structural or solid filler material for improving mechanical properties. A substantially identical, similar, or analogous improvement can be obtained by the addition of other types of filler materials (which can be organic or inorganic filler materials) such as $MoS_2$, $WS_2$, $TiO_2$, graphene, C60, UHMWPE, PTFE, PEEK etc. . . . . The extent of improvement will depend on the type of filler material(s) and eventually the type of interaction(s) between SU-8 and the added filler material(s).

Spin coating and/or dip coating can be used to produce coatings, layers, or films in accordance with embodiments of the present disclosure on different types of substrates. Other techniques for producing coatings in accordance with embodiments of the disclosure, such as brushing, sol-gel, spraying, sputtering etc. . . . , can be used to obtain SU-8+PFPE nanocomposite coatings or layers having substantially identical, similar, or analogous properties.

In accordance with another aspect of the present disclosure, a coating, layer, or film (e.g., an SU-8 nanocomposite film) can be selectively or preferentially positioned relative to or upon a target surface or interface in order to improve the tribological and/or mechanical properties of the target surface or interface. Herein, the term "Lub tape" refers to various embodiments of (a) a coating, layer, or film (e.g., a substantially homogeneous hybrid polymer nanocomposite) that can be selectively positioned relative to a target surface, interface, or structure; and possibly (b) a corresponding support film, layer, medium, or material that carries the film. The layer provides at least one of enhanced tribological and mechanical properties relative to its support medium. For instance, the layer can provide Lub-tape with a first side having target or desired tribological and/or mechanical properties; and the support medium can provide the Lub-tape with a second side having different tribological and/or mechanical properties (e.g., a higher coefficient of friction, a lower elastic modulus, and/or lower hardness) than the Lub-tape's first side.

Figure 2:
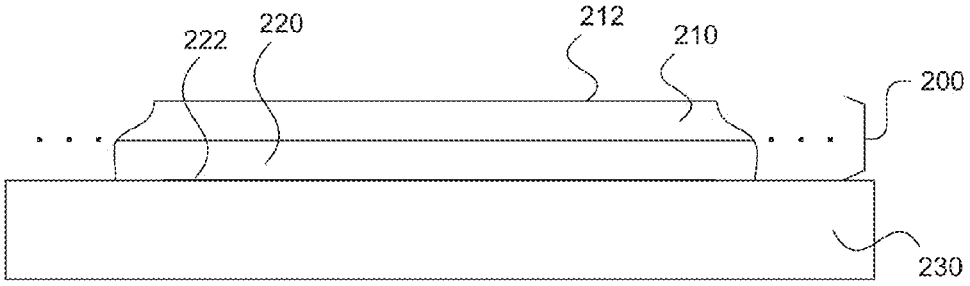
FIG. 2: Representative Lub-tape structure in accordance with an embodiment of the present disclosure.
Figure 3:
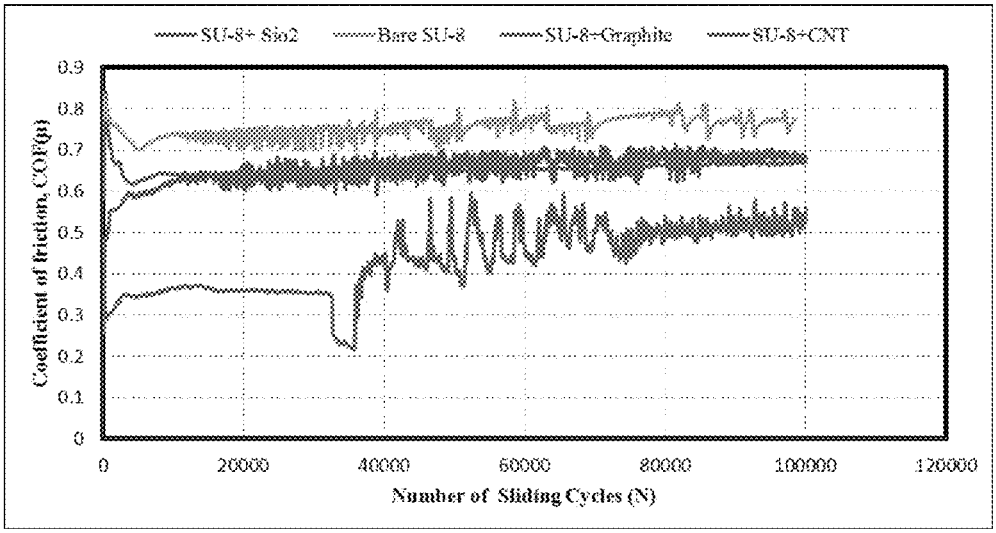
FIG. 3: Coefficient of friction versus number of sliding cycles data for SU-8, SU-8+$SiO_2$, SU-8+CNTs and SU-8+Graphite obtained from the ball-on-disk sliding tests against 4 mm diameter $Si_3N_4$ ball at a normal load of 30 g and a sliding rotation of 200 rpm.
Figure 4:
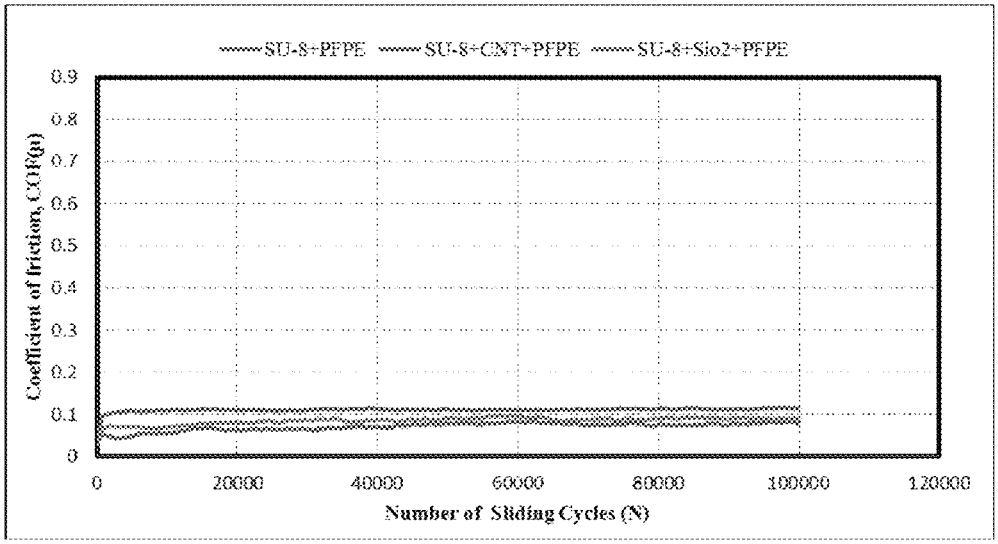
FIG. 4: Coefficient of friction versus number of sliding cycles data for SU-8+PFPE, SU-8+PFPE+$SiO_2$ and SU-8+PFPE+CNT obtained from the ball-on-disk sliding tests against 4 mm diameter $Si_3N_4$ ball at a normal load of 300 g and a sliding rotation of 200 rpm.
Figure 5:
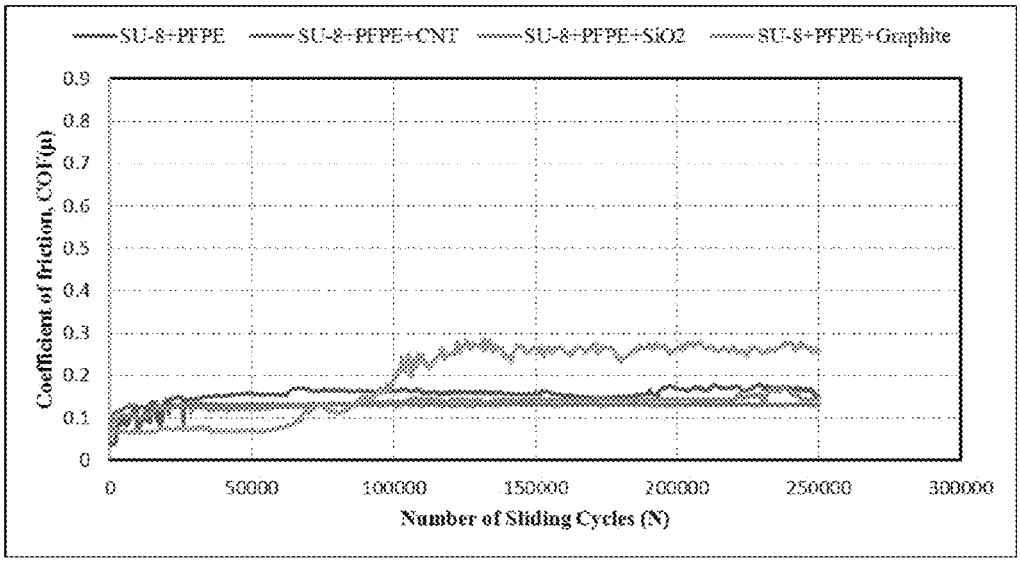
FIG. 5: Coefficient of friction versus number of sliding cycles data for SU-8+PFPE, SU-8+PFPE+$SiO_2$, SU-8+PFPE+CNT and SU-8+PFPE+Graphite obtained from the ball-on-disk sliding tests against 4 mm diameter $Si_3N_4$ ball at a normal load of 300 g and a sliding rotation of 500 rpm.
Figure 6:
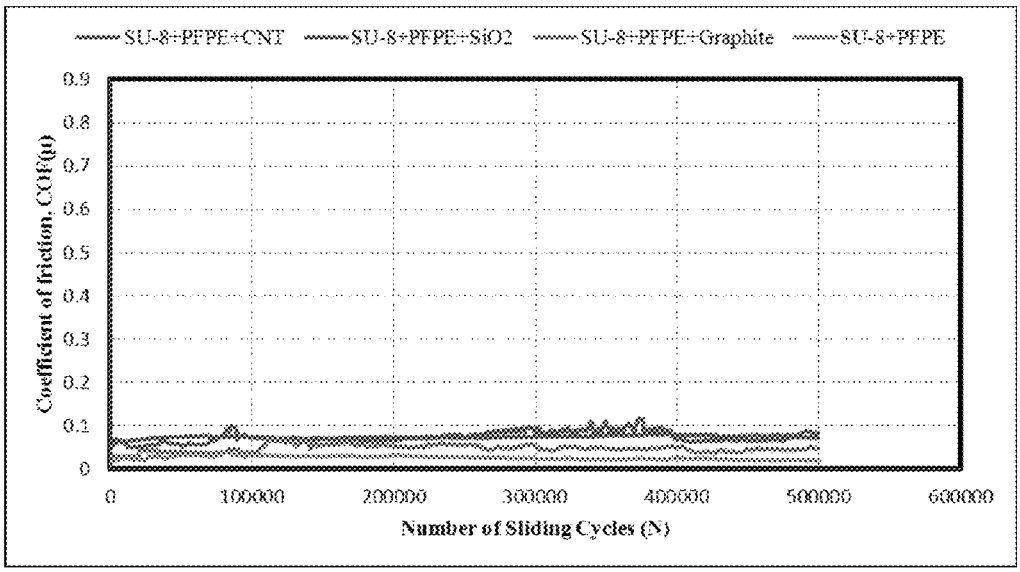
FIG. 6: Coefficient of friction versus number of sliding cycles data for SU-8+PFPE, SU-8+PFPE+$SiO_2$, SU-8+PFPE+CNT and SU-8+PFPE+Graphite obtained from the ball-on-disk sliding tests against 4 mm diameter $Si_3N_4$ ball at a normal load of 300 g and a sliding rotation of 1000 rpm.
Figure 7:
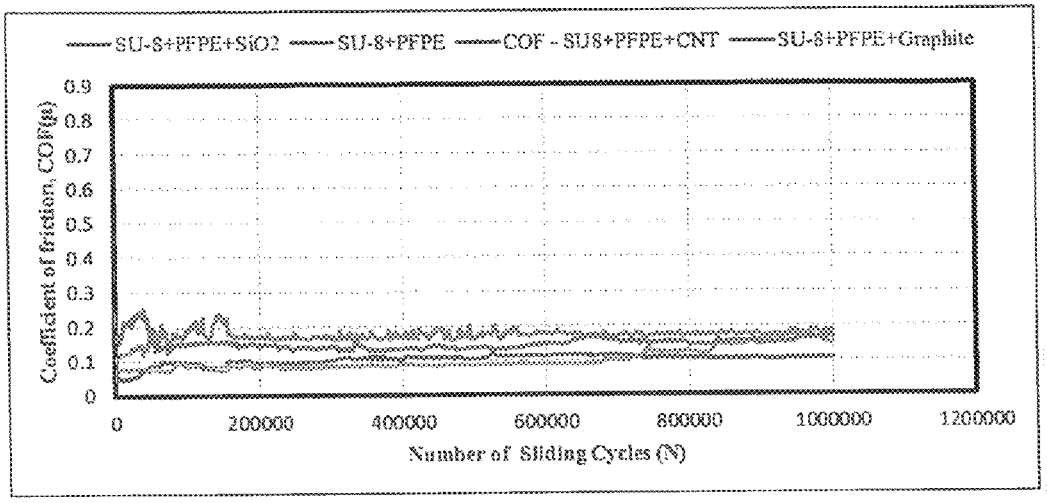
FIG. 7: Coefficient of friction versus number of sliding cycles data for SU-8+PFPE, SU-8+PFPE+$SiO_2$, SU-8+PFPE+CNT and SU-8+PFPE+Graphite obtained from the ball-on-disk sliding tests against 4 mm diameter $Si_3N_4$ ball at a normal load of 300 g and a sliding rotation of 2000 rpm.

FIG. 2 is an illustration of a representative Lub-tape structure in accordance with an embodiment of the disclosure. In several embodiments, Lub-tape can be a self-contained, isolatable/isolated, dispensable, stand-alone, or free standing film or laminate structure 200 that includes a nanocomposite film or layer 210 providing desired or enhanced tribological and/or mechanical properties, as well as a carrier film or layer 220 associated with the nanocomposite film (e.g., an underlying polymer film, on which the nanocomposite film resides). A free standing Lub-tape film 200 can be separated from a support member, support structure, or release layer 230 that facilitates Lub-tape manufacture, such that the free standing Lub-tape film 200 can be selectively positioned relative to a target surface or interface. In a number of embodiments, Lub-tape includes one side 212 that exhibits a low friction property corresponding to the nanocomposite film, and another side 222 having a high or higher friction property corresponding to a carrier film or a support medium.

Lub-tape can be applied or adhered (e.g., selectively or preferentially adhered) to or between surfaces where a reduction in friction and/or an increase in wear durability are desired, intended, or needed. The Lub-tape's high(er) friction surface can be applied, adhered, attached, or otherwise secured to a target surface of interest, for instance, using a common adhesive material, backing, or glue (such as epoxy glue), while the Lub-tape's low friction surface faces against a target counterface material. Lub-tape can be applied or adhered to a surface prior to or at the beginning of mechanical wear processes associated with the surface on which the Lub-tape resides, or following a time period during which mechanical wear has already occurred.

More particularly, Lub-tape can significantly or dramatically reduce the friction of device parts that exhibit unnecessarily or undesirably high friction, such as device parts which are already deployed or which are in use or in application, and which exhibit increased friction (e.g., which have lost an initial low friction property) because of wear and tear. In such cases, SU-8 nanocomposite Lub-tape can be adhered to particular surfaces to extend or enhance their operating life. In addition to the use of Lub-Tape in structures or devices where the restoration of improved tribology is useful or needed (e.g., for components already in application, which have lost their low-friction and low-wear properties), Lub-Tabe can also be used in applications in which friction between two fresh sliding surfaces is undesirable and can or should be reduced or minimized.

In several embodiments, an overall thickness of an SU-8+PFPE based Lub-tape film is approximately 150 microns. If this thickness is not sufficient to withstand higher loads and/or higher speeds, e.g., in macro-machinery applications, films with greater thickness (e.g., exceeding 150 microns, up to approximately 2 mm or more) can be produced. Using an appropriate SU-8 grade, a thickness of up to 300 μm can easily be obtained in one spin-coating process while up to 2 mm thicknesses can be obtained by multilayer coatings using multiple spin-coatings [Conradie and Moore 2002].

Experiments Determining Tribological and Mechanical Properties

Experiments or tests to determine tribological and mechanical properties of various SU-8 based films, including nanocomposite films, in accordance with embodiments of the present disclosure are provided as follows:

Experiment 1

Evaluation of SU-8 Nanocomposites on Si

In this experiment, SU-8 based films were spin coated onto Si and then they were subsequently characterized for their tribological properties and mechanical properties.

Experimental Procedures:

Materials and Sample Preparation:

Si wafers were cut into ~2 cm×2 cm pieces and were thoroughly cleaned with soapy water, distilled water and isopropyl alcohol (IPA), respectively, and finally dried with $N_2$ gas. The cleaned Si wafers were then subjected to heating at 150° C. for about 3-4 min to remove any adsorbed moisture content and then subsequently treated with the oxygen for about 15-20 min using plasma cleaner PDC-32G (Harrick plasma, N.Y., USA). The purpose of the oxygen plasma treatment was to remove the contaminants and to generate hydroxyl groups on the surface which eventually enhance the adhesion between the substrate and the coating. The cleaned Si wafers were then subjected to the spin coating immediately by using SCS P6700 spin coater (Speciality Coating Systems, Indiana, USA). The SU-8 used for the sample preparation was SU-8 2050 (Microchem Ltd, USA). For the preparation of the pristine SU-8 films, SU-8 was spin coated onto Si at an initial speed of 500 rpm for duration of 5 seconds, followed by an increase in the spinning speed to 3000 rpm for duration of 30 seconds which results in SU-8 films with a thickness of ~150 microns. The spin coated SU-8 films were then subjected to the pre-baking at a temperature of 65° C. for 4 minutes followed by 95° C. for 9 minutes. The pre-baked SU-8 films were then exposed to UV (ultra-violet) rays (wavelength: 365 nm and power: 210 mJ/cm$^2$) for a duration of 1 min by using Black-Ray B-100SP UV lamp (UVP, LLC, upland, CA, USA). A post exposure bake was carried out at a temperature of 65° C. for 1 minute followed by 95° C. for 7 min, after UV exposure. The samples were then stored in the desiccators before any further characterization. The conditions of the spin coating, pre-baking, UV curing, post-baking are approximately same for both pristine SU-8 films and SU-8 nanocomposite films.

For the preparation of the SU-8+PFPE nanocomposites, a 5 wt % of PFPE was added to SU-8 2050 and then the composite material was thoroughly mixed by using magnetic stirring for about 2 hrs and then the composite solution was used for spin coating. Whereas for the preparation of SU-8+PFPE+NP (NP stands for nanoparticle), 5 wt % of PFPE and 5 wt % of NP was added to SU-8 2050 along with few drops of SU-8 thinner and the whole mixture was thoroughly mixed using magnetic stirring for about 2 hr and then the mixture was used for spin coating.

Tribological Testing:

Friction and wear tests were carried out using UMT-2 (Universal Micro Tribometer, CETR, USA) in ball-on-disk mode where the coefficient of friction was measured with respect to the number of sliding cycles. A $Si_3N_4$ ball of 4 mm diameter with a surface roughness of 5 nm was used as the counterface. The tests were conducted at different normal loads (up to 300 g) and at different rotational speeds (up to 2000 rpm), respectively. All experiments were performed in air at room temperature (23° C.) and at a relative humidity of approximately 60%. From the sliding tests, an initial coefficient of friction ($\mu_i$) was noted after 16 s of sliding and the steady-state coefficient of friction ($\mu_s$) was noted after the stabilization of the coefficient of friction and reported the same in the present document. The wear life for the tested conditions was taken as the number of sliding cycles after which the coefficient of friction exceeded 0.3 or a visible wear scar was observed on the substrate with fluctuating friction values, whichever occurred earlier. For each modification, 3 tests were repeated and average data are reported. An optical microscope was used to image the worn surfaces after the sliding tests to assess the damage to the film surfaces and the ball, respectively.

Nanoindentation Testing:

The elastic modulus and the hardness of the SU-8 based films were measured using a MTS Nano Indenter XP with a continuous stiffness measurement (CSM) technique. A triangular pyramid Berkovich diamond indenter was employed for nanoindentation tests. The depth of indentation was set to 3,000 nm. The CSM technique has the load and the displacement resolutions as 50 nN and <0.01 nm, respectively. A total of 10 indents were done on each sample and the tests were repeated on 3 different samples and an average value is reported.

Results:

The SU-8 films formed under the conditions provided in the experimental section have shown a thickness of ~100 μm. Both the pristine and the SU-8 nanocomposite films have shown same thickness values.

TABLE 1

Initial coefficient of friction ($\mu_i$), Steady-state coefficient of friction ($\mu_s$) and wear life (number of sliding cycles) of SU-8 and SU-8 composites obtained from sliding tests against 4 mm diameter $Si_3N_4$ ball at different normal loads and sliding rotational speeds.

| Test and Nanocomposite Description | | Initial coefficient of friction, COF ($\mu_i$) | Steady-state coefficient of friction, COF ($\mu_s$) | Wear Life (Number of Cycles) |
|---|---|---|---|---|
| 30 g, 200 rpm, Spin Coated on Si | Bare SU-8 | 0.82 | 0.7 | <500 |
| | SU-8 + SiO2 | 0.77 | 0.64 | <1000 |
| | SU-8 + CNTs | 0.39 | 0.65 | <1000 |
| | SU-8 + Graphite | 0.35 | 0.58 | <2000 |
| 300 g, 500 rpm, Spin Coated on Si | SU-8 + PFPE | 0.04 | 0.14 | >250000 |
| | SU-8 + PFPE + SiO2 | 0.04 | 0.09 | >250000 |
| | SU-8 + PFPE + CNTs | 0.06 | 0.13 | >250000 |
| | SU-8 + PFPE + Graphite | 0.05 | 0.25 | >250000 |
| 300 g, 1000 rpm, Spin Coated on Si | SU-8 + PFPE | 0.01 | 0.02 | >500000 |
| | SU-8 + PFPE + SiO2 | 0.06 | 0.08 | >500000 |
| | SU-8 + PFPE + CNTs | 0.02 | 0.03 | >500000 |
| | SU-8 + PFTE + Graphite | 0.02 | 0.06 | >500000 |
| 300 g, 2000 rpm, Spin Coated on Si | SU-8 + PFPE | 0.07 | 0.09 | >1000000 |
| | SU-8 + PFPE + SiO2 | 0.06 | 0.11 | >1000000 |
| | SU-8 + PFPE + CNTs | 0.09 | 0.17 | >1000000 |
| | SU-8 + PFPE + Graphite | 0.09 | 0.14 | >1000000 |

Table 1 shows the initial coefficient of friction ($\mu_i$), steady-state coefficient of friction ($\mu_s$) and wear life of pristine SU-8 based films tested at different normal loads and rotational speeds. The tribological properties obtained at a normal load of 300 g and a rotational speed of 500 rpm will be mainly discussed in this section and the data at other loads can be referred from Table 1. The pristine SU-8 film has shown high friction properties ($\mu_i$: 0.87 and $\mu_s$: 0.76) and low wear life (n<500) when tested at a normal load of 30 g and a rotational speed of 200 rpm. The high coefficient of friction and low wear life of SU-8 clearly indicate the necessity for the works involving the methods to improve the tribological properties of SU-8. SU-8 molecules have poor lubricious nature and also low elastic modulus of SU-8 (E: ~4-5 GPa) usually shows high contact area when pressed by the $Si_3N_4$ ball under the applied load and hence shows high friction. Under the loading conditions of the normal load of 300 g and the rotational speed of 500 rpm, SU-8+PFPE has shown very low coefficients of friction ($\mu_i$: 0.04 and $\mu_s$: 0.14) and high wear life (n>500,000). This is a dramatic improvement when compared with the pristine SU-8.

TABLE 2

Elastic modulus (GPa) and hardness (GPa) of SU-8 and SU-8 composites obtained through nanoindentation tests using MTS Nano Indenter XP with Continuous Stiffness Measurement (CSM).

| Nanocomposite Description | Elastic Modulus (GPa) | Hardness (GPa) |
|---|---|---|
| SU-8 | 3.7-3.9 | 0.25-0.29 |
| SU-8 + NP | 3.8-4.0 | 0.16-0.17 |
| SU-8 + PFPE | 3.8-4.3 | 0.3-0.34 |
| SU-8 + PFPE + SiO2 | 4.4-4.7 | 0.37-0.42 |

TABLE 2-continued

Elastic modulus (GPa) and hardness (GPa) of SU-8 and SU-8 composites obtained through nanoindentation tests using MTS Nano Indenter XP with Continuous Stiffness Measurement (CSM).

| Nanocomposite Description | Elastic Modulus (GPa) | Hardness (GPa) |
|---|---|---|
| SU-8 + PFPE + CNTs | 3.8-4.1 | 0.26-0.3 |
| SU-8 + PFPE + Graphite | 4.8-5.15 | 0.15-0.16 |

Table 2 shows the elastic modulus and the hardness data of SU-8 based films. Pristine SU-8 film shows an elastic modulus of ~3.8 GPa and a hardness of ~0.27 GPa and the addition of PFPE does not have a significant effect on the mechanical properties of SU-8 (for SU-8+PFPE, E: 4.0 GPa and H: 0.32 GPa) except a slight increase. Therefore, the nanocomposite SU-8+PFPE shows significant improvement in tribological properties (the $\mu_i$ has been reduced by ~22 times, the $\mu_s$ has been reduced by ~5 times and the wear life has been improved by >1000 times) with a marginal improvement in the mechanical properties when compared to pristine SU-8. SU-8+NP sample has shown a $\mu_i$ of 0.8, $\mu_s$ of 0.68 and the wear life of <1000 cycles and also E of 3.9 GPa and H of 0.17 GPa, respectively. This composite of SU-8 with the nanoparticle addition did not improve the tribological properties and have shown the similar elastic modulus as that of SU-8 and also have slightly reduced the hardness. Therefore, we further continued with the fabrication of hybrid SU-8 nanocomposites with the addition of PFPE and the nanoparticles.

The weight percent added in the nanoparticle composites was approximately 5 wt %. SU-8+PFPE+$SiO_2$ has shown $\mu_i$ of 0.04, $\mu_s$ of 0.09 and wear life of >500,000 cycles and E of 4.5 GPa and H of 0.40 GPa. These properties are of significant improvement when compared to pristine SU-8. When compared to SU-8+PFPE, SU-8+PFPE+$SiO_2$ has shown similar tribological performance and improved mechanical properties. SU-8+PFPE+CNTs has shown $\mu_i$ of 0.06, $\mu_s$ of 0.13 and wear life of >500,000 cycles and E of 4.0 GPa and H of 0.28 GPa. SU-8+PFPE+Graphite has shown $\mu_i$ of 0.05, $\mu_s$ of 0.25 and wear life of >500,000 cycles and E of 5.0 GPa and H of 0.16 GPa. Among the three hybrid SU-8 nanocomposites, all three have shown similar improvements in their tribological performance and SU-8+PFPE+Graphite has shown highest elastic modulus while SU-8+PFPE+$SiO_2$ has shown highest hardness. Overall, these hybrid composites have shown improved tribological performance and mechanical properties, both at the same time. The selection of right composite entirely depends on the application i.e. high hardness/modulus requirement.

In view of the foregoing, it can be expected that in some embodiments, a simultaneous optimization of elastic modulus and hardness, while retaining significantly or greatly reduced coefficient of friction, can be achieved by way of a composition that includes $SiO_2$ for purpose of hardness enhancement, plus Graphite for purpose of elastic modulus enhancement. Such a composition can include or be based upon a polymer such as SU-8; a liquid lubricant such as PFPE; $SiO_2$; and Graphite.

FIG. 3-7 show the coefficient of friction versus number of sliding cycles graph for all the samples tested in this experiment. The tribological properties summarized in Table 1 have been obtained from these graphs.

Figure 8A:
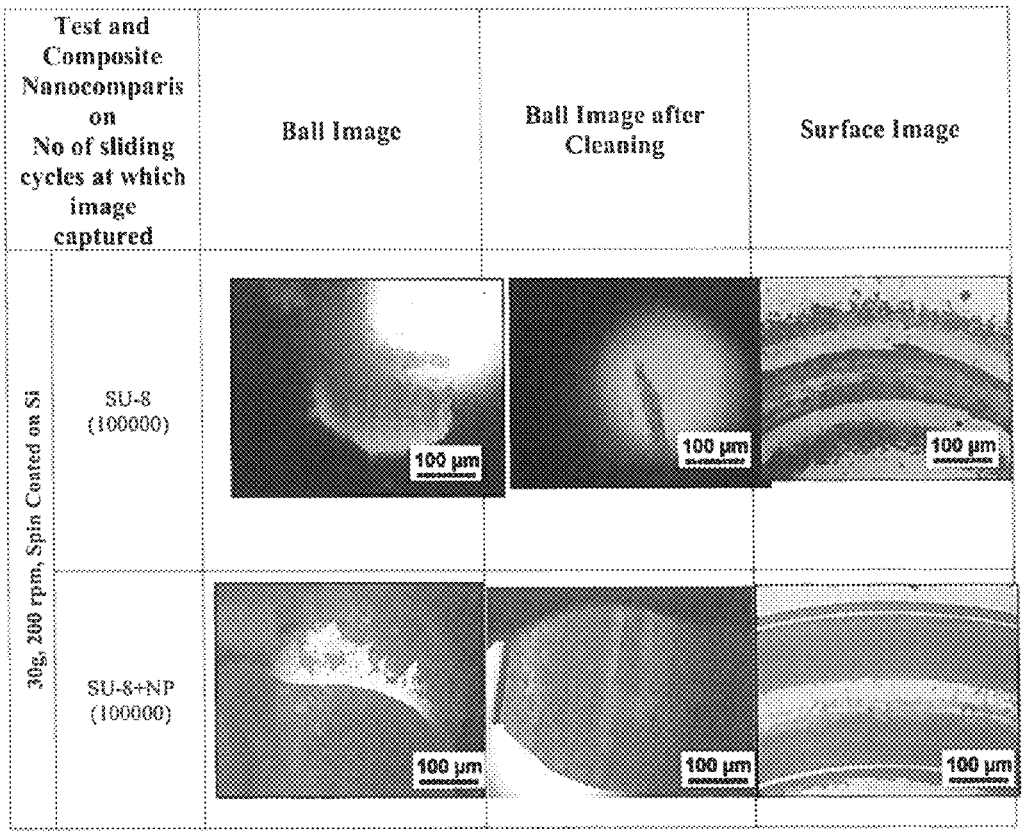
FIGS. 8A, 8B, and 8C: Optical micrographs of the ball surface after sliding tests, after cleaning the tested ball with acetone and the wear track surface of SU-8, SU-8+NP, SU-8+PFPE, SU-8+PFPE+CNTs, SU-8+PFPE+SiO2 and SU-8+PFPE+Graphite after appropriate number of sliding cycles at the mentioned testing conditions.
Figure 8B:
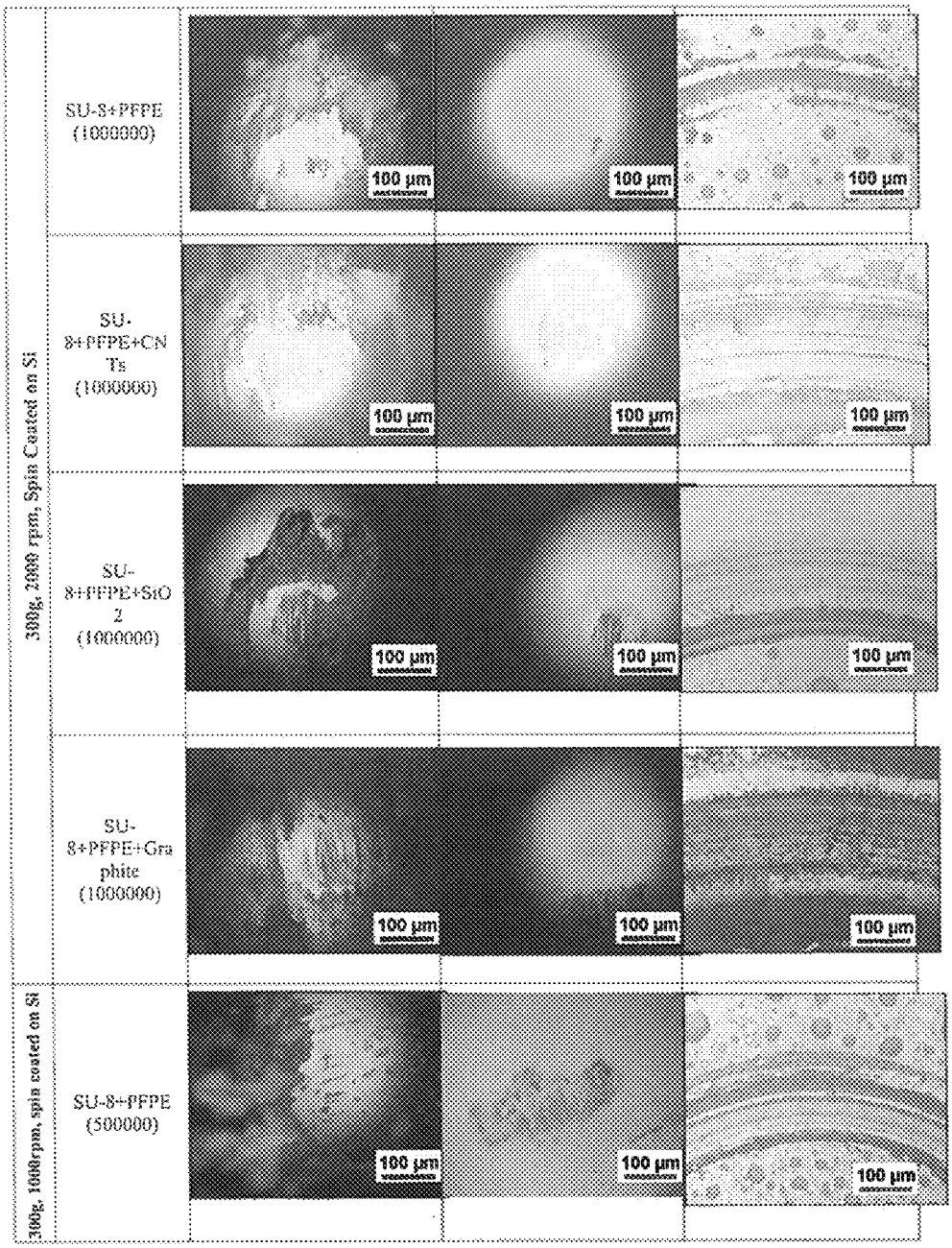
Figure 8C:
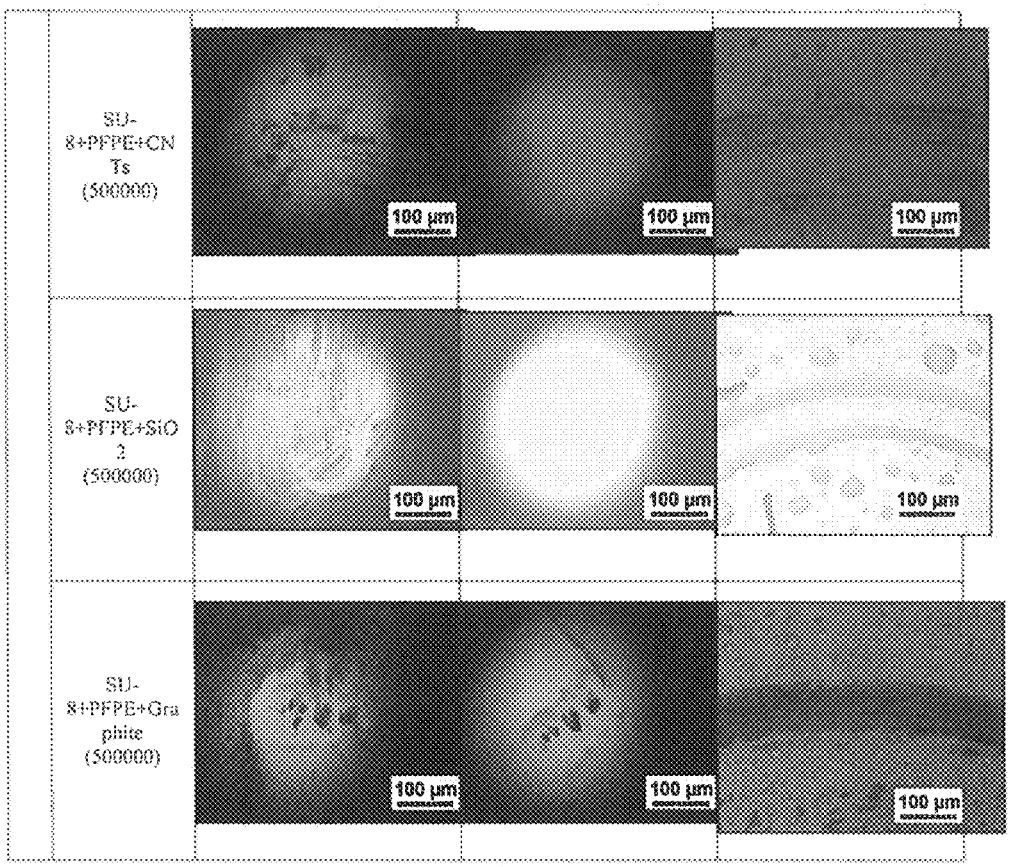

FIGS. 8A, 8B, and 8C show the optical micrographs of the ball surface after sliding tests, the tested balls after cleaning with acetone and the optical images of worn surfaces after appropriate number of cycles. These images qualitatively support the tribological data explained in the preceding paragraphs.

Experiment 2

Evaluation of SU-8+PFPE Based Coatings on Different Substrates

In this experiment, SU8+PFPE based films were dip-coated onto different substrates such as Si, steel, stainless steel, aluminum and glass to establish its ability to work as a solid lubricant over the machine parts and then subsequently characterized for their tribological properties.

Experimental Procedures:

Substrates (Si, steel, stainless steel, aluminum and glass) of 2 cm×2 cm were cut and thoroughly cleaned with soapy water, distilled water and IPA, respectively. For dip-coating, we have to use the SU-8 with low viscosity and hence we have used SU-8 2005. For the preparation of dip-coated samples, the cleaned substrates were heated at 150° C. for few minutes to remove any adsorbed moisture and subsequently subjected to oxygen-plasma treatment for 15-20 min. The purpose of oxygen plasma treatment was to remove any contaminants and to generate functional groups which eventually enhance the adhesion between the substrate and the coating. A concentration of 5 wt % PFPE was added to SU-8 to prepare the composite films. The oxygen plasma treated samples were then subjected to dip-coating with SU-8 2005+PFPE. Dip-coating was done with a custom-built dip-coating machine using a dipping time of 60 s and a withdrawal speed of 2.1 mm/s. The dip-coated samples were then pre-baked at 95° C. for 4 min and then subjected to UV treatment (wavelength: 365 nm and power: 210 mJ/cm$^2$) for 30 s and finally post-baked for 4 min at 95° C. The dip-coated samples were stored in desiccators before any further characterization.

Tribological Testing:

Friction and wear tests were carried out using UMT-2 in the ball-on-disk mode. The $Si_3N_4$ ball of 4 mm diameter with the surface roughness of 5 nm was used as the counterface. The tests were conducted at a normal load of 300 g and a rotational speed of 500 rpm. For each modification, 3 tests were repeated and average data are reported. An optical microscope was used to image the worn surfaces after the sliding tests to assess the damage to the film surfaces and the ball, respectively.

Results:

The thickness of the SU-8+PFPE composite coating on the substrates was ~75-100 microns (which was measured using WYKO NT1100 optical profiler).

Figure 9:
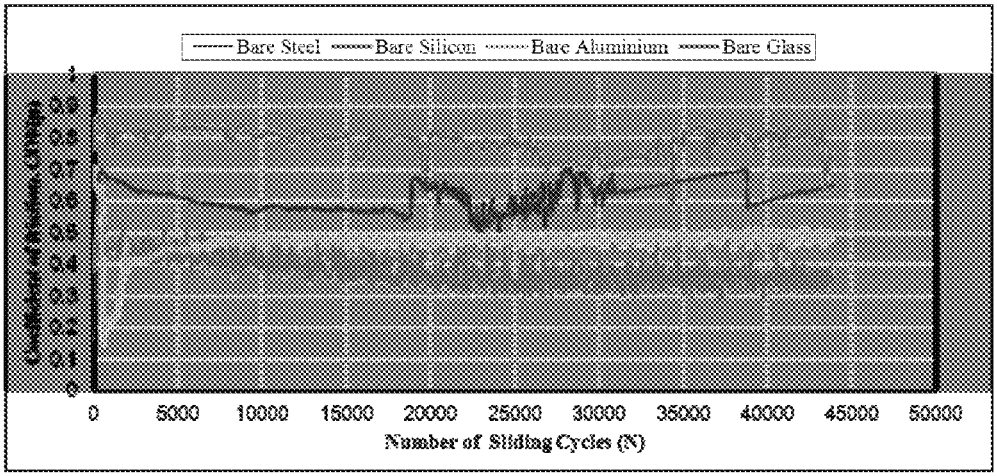
FIG. 9: Coefficient of friction versus number of sliding cycles data for different bare substrates i.e. Si, steel, aluminum and glass, respectively, obtained from ball-on-disk sliding tests against 4 mm diameter $Si_3N_4$ balls at a normal load of 300 g and a sliding rotation of 500 rpm.
Figure 10:
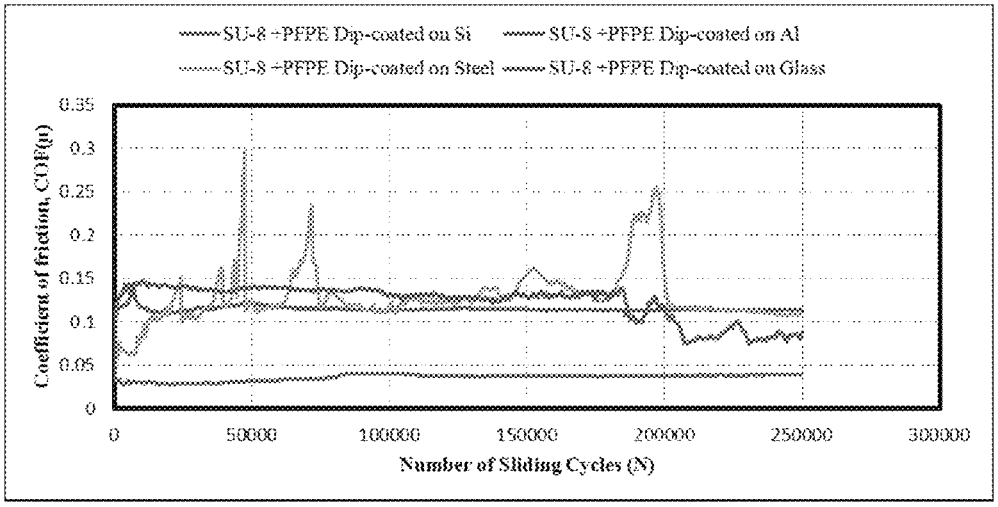
FIG. 10: Coefficient of friction versus number of sliding cycles data for SU-8+PFPE films dip-coated onto Si, steel, aluminum and glass, respectively, obtained from ball-on-disk sliding tests against 4 mm diameter $Si_3N_4$ balls at a normal load of 300 g and a sliding rotation of 500 rpm.
Figure 11A:
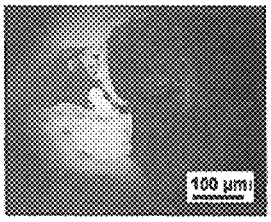
FIGS. 11A, 11B, and 11C: Optical micrographs of the ball surface after sliding tests, after cleaning the tested ball with acetone and the wear track surface of different bare and SU-8+PFPE dip-coated substrates i.e. Si, steel, stainless steel, aluminum and glass, respectively. The testing conditions and the number of cycles after which the images captured are mentioned.
Figure 11A:
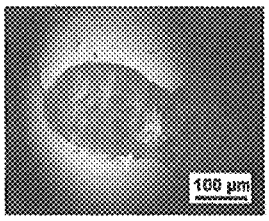
Figure 11A:
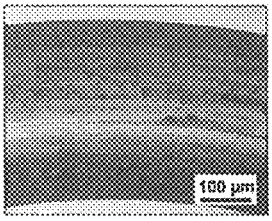
Figure 11A:
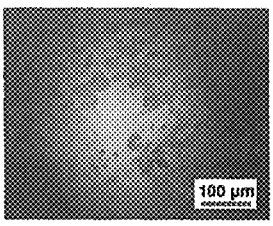
Figure 11A:
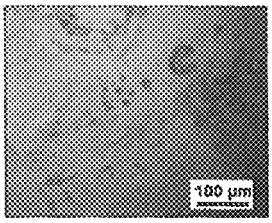
Figure 11A:
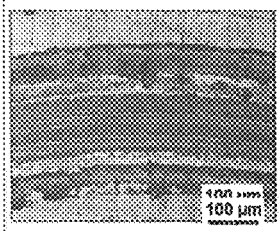
Figure 11A:
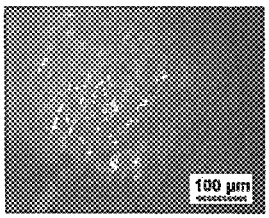
Figure 11A:
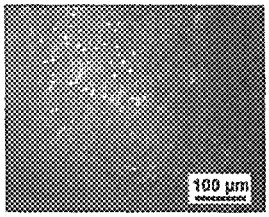
Figure 11A:
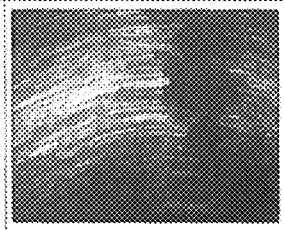
Figure 11B:
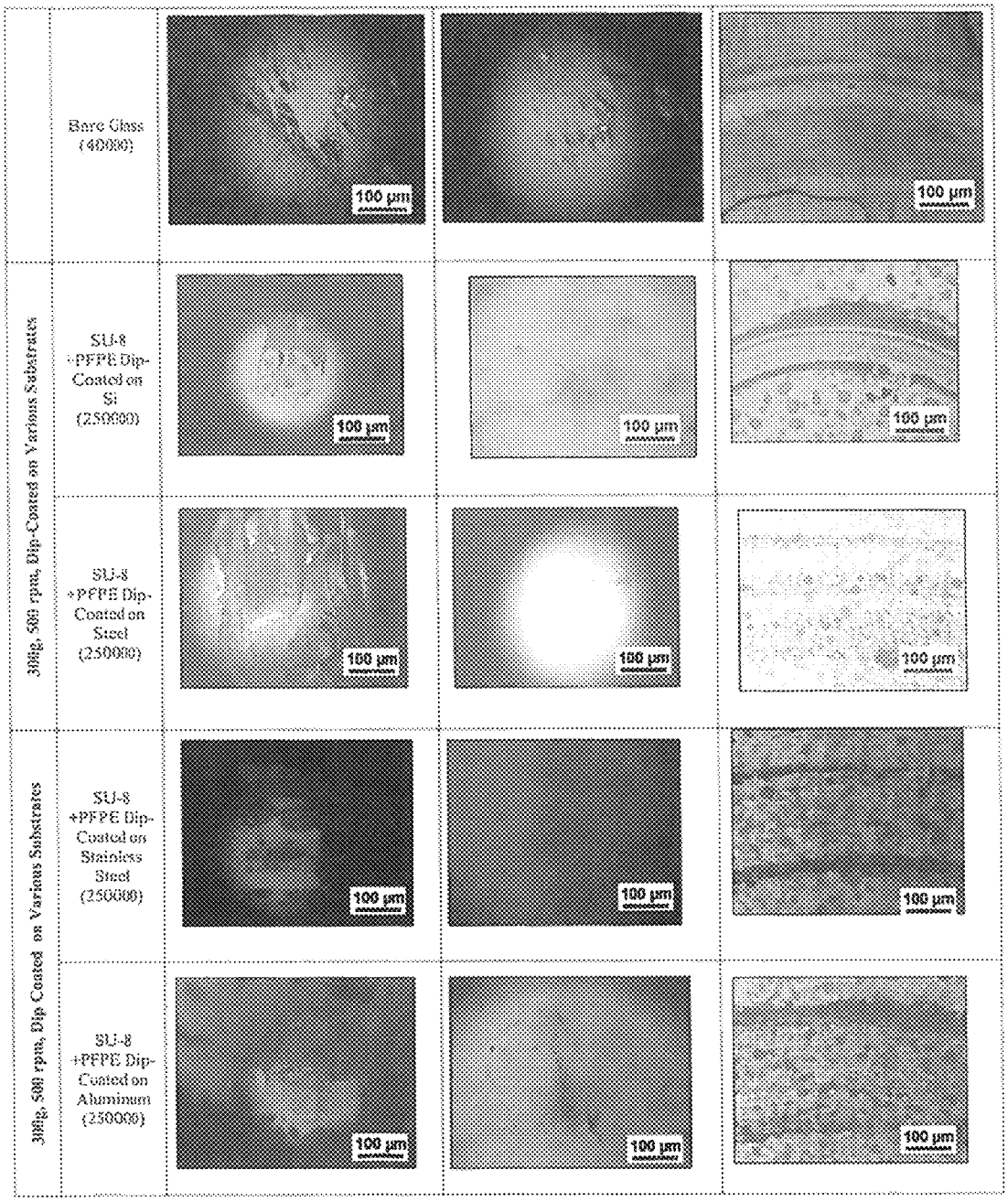
Figure 11C:
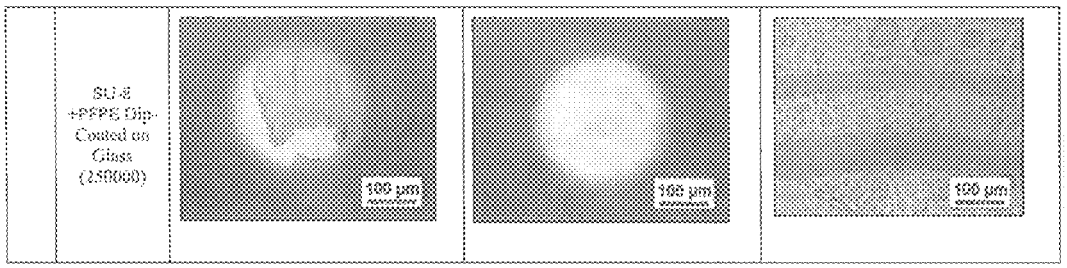

Table 3 shows the initial coefficient of friction ($\mu_i$), steady-state coefficient of friction ($\mu_s$) and wear life of bare substrates without any lubricant coating and SU-8+PFPE coated substrates tested at a normal load of 300 g and a rotational speed of 500 rpm, respectively, and the corresponding coefficient of friction versus number of sliding cycles curves are shown in FIG. 9 and FIG. 10. All substrates without any coating have shown high coefficients of friction (Si—$\mu_i$: 0.52 and $\mu_s$: 0.46; Steel—$\mu_i$: 0.48 and $\mu_s$: 0.64; Al—$\mu_i$: 0.66 and $\mu_s$: 0.44 and Glass—$\mu_i$: 0.8 and $\mu_s$: 0.8) and low wear lives (n<1000). When tested under the same conditions, the dip-coated samples (with SU-8+PFPE composite film) have shown low coefficients of friction (Si—$\mu_i$: 0.02 and $\mu_s$: 0.04, Steel—$\mu_i$: 0.04 and $\mu_s$: 0.1, Al—$\mu_i$: 0.06 and $\mu_i$: 0.2, Glass—$\mu_i$: 0.04 and $\mu_s$: 0.12) and very high wear lives (n>250000). Therefore, the SU-8+PFPE nanocomposite coating have dramatically improved the tribological properties of the substrates i.e. Si, steel, stainless steel, aluminum and glass (the $\mu_i$ has been reduced by up to ~20 times, the $\mu_s$ has been reduced by up to ~7 times and the wear life has been improved by >250 times). FIGS. 11A, 11B, and 11C shows the optical micrographs of the ball surface after sliding tests, the tested balls after cleaning with acetone and the optical images of worn surfaces after appropriate number of cycles. These optical images of the balls and worn surfaces qualitatively support the tribological properties listed in Table 3 and explained as above.

FIG. 9 shows the coefficient of friction versus number of sliding cycles graph for all bare samples tested in this experiment. FIG. 10 shows the coefficient of friction versus number of sliding cycles graph for all SU8+PFPE dip-coated samples tested in this experiment. The tribological properties summarized in Table 3 were obtained from these graphs.

Experiment 3

Fabrication and Tribological Property Evaluation of "Lub-Tape"

In this experiment, SU-8 film based "Lub-tape" were spin coated onto OHP polyethylene sheets and aluminum foil and then subsequently characterized for their tribological properties. For these feasibility studies regarding Lub-tapes, only one composite i.e. SU-8+PFPE was used and only the tribological characterization was done.

TABLE 3

Initial coefficient of friction ($\mu_i$), Steady-state coefficient of friction ($\mu_s$) and wear life (number of sliding cycles) of different substrates i.e. Si, steel, stainless steel, aluminum and glass, respectively, with and without the dip-coated SU-8 + PFPE films, obtained from ball-on-disk sliding tests against 4 mm diameter $Si_3N_4$ balls at a normal load of 300 g and a sliding rotation of 500 rpm.

| Test and Nanocomposite Description | | Initial coefficient of friction, COF ($\mu_i$) | Steady-state coefficient of friction, COF ($\mu_s$) | Wear Life (Number of Cycles) |
|---|---|---|---|---|
| 300 g, 500 rpm, Dip-Coated on Various Substrates | Bare Silicon (Si) | 0.52 | 0.46 | <1000 |
| | Bare Steel | 0.48 | 0.64 | <1000 |
| | Bare Stainless Steel | 0.4 | 0.55 | <1000 |
| | Bare Aluminum | 0.66 | 0.44 | <1000 |
| | Bare Glass | 0.8 | 0.8 | <1000 |
| | SU-8 + PFPE Dip-coated on Si | 0.02 | 0.04 | >250000 |
| | SU-8 + PFPE Dip-coated on Steel | 0.04 | 0.1 | >250000 |
| | SU-8 + PFPE Dip-coated on Stainless Steel | 0.04 | 0.13 | >250000 |
| | SU-8 + PFPE Dip-coated on Aluminum | 0.06 | 0.2 | >250000 |
| | SU-8 + PFPE Dip-coated on Glass | 0.04 | 0.12 | >250000 |

Experimental Procedures:

OHP sheet wafers were cut into ~3 cm×3 cm pieces and were thoroughly cleaned with soapy water, distilled water and isopropyl alcohol (IPA), respectively, and finally dried with $N_2$ gas. The cleaned OHP sheet wafers were then subjected to the spin-coating immediately. The SU-8 used for the sample preparation was SU-8 2050. For the preparation of the "Lub-tape" films, SU-8 was spin-coated onto OHP sheet wafer at an initial speed of 500 rpm for duration of 5 seconds, followed by an increase in the spinning speed to 3000 rpm for a duration of 60 seconds which results SU-8 films with a thickness of ~75 microns. Thicknesses of the films were measured using WYKO NT1100 optical profiler (Vecco Instruments Inc, USA). The spin-coated SU-8 films were then subjected to the pre-baking at a temperature of 65° C. for 4 minutes followed by at 95° C. for 9 minutes. The pre-baked SU-8 films were then again subjected to spin-coating of SU8+PFPE film over the pre-baked SU8 film at an initial speed of 500 rpm for duration of 5 seconds, followed by an increase in the spinning speed to 3000 rpm for duration of 60 seconds which results in the SU-8+PFPE film with a thickness of ~75 microns. The spin coated SU-8+PFPE films over SU8 films on the same wafer were then subjected to the pre-baking at a temperature of 65° C. for 4 minutes followed by 95° C. for 9 minutes. Then the spin-coated SU8+PFPE film along with the bare SU8 film was subjected to UV (ultra-violet) rays (wavelength: 365 nm and power: 210 mJ/cm$^2$) for a duration of 30 seconds. A post-exposure bake was carried out at a temperature of 65° C. for 1 minute and followed by 95° C. for 7 min, after UV exposure. Finally, the "Lub-tape" film was peeled off from the OHP substrate with mild heating. The peeled off Lub-tapes were stored in the desiccators before any further characterization.

Tribological Testing:

Friction and wear tests were carried out using the UMT-2 in ball-on-disk mode. The $Si_3N_4$ ball of 4 mm diameter with the surface roughness of 5 nm was used as the counterface. The tests were conducted at different normal loads (up to 300 g) and at different rotational speeds (up to 2000 rpm), respectively. For each modification, 3 tests were repeated and average data are reported. An optical microscope was used to image the worn surfaces after the sliding tests to assess the damage to the film surfaces and the ball, respectively.

Figure 12:
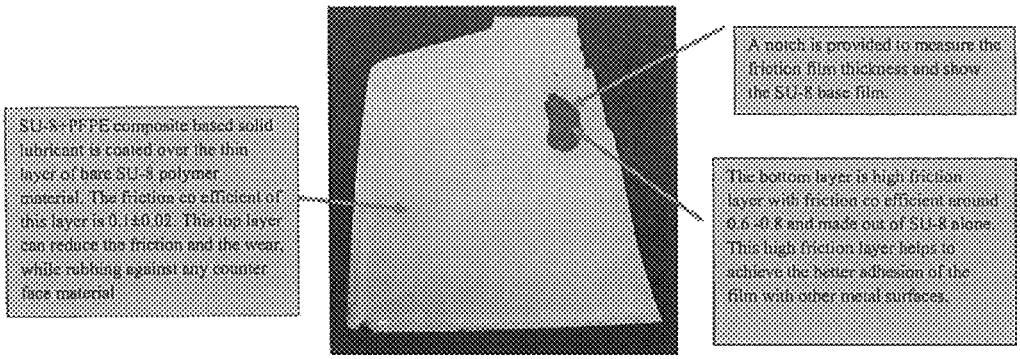
FIG. 12: Free standing SU-8 based double sided tape (named as "Lub-tape") with one side having high coefficient of friction (~0.6-0.7) and the other side having low coefficient of friction (~0.04-0.1), respectively.

Results:

The SU-8 based "Lub—Tape" films formed under the conditions provided in the experimental section have shown a thickness of ~150 μm. FIG. 12 shows the low and high friction features of film and descriptions about them.

TABLE 4

Tribological test results of SU-8 Lub-tape (Initial coefficient of friction ($\mu_i$), Steady-state coefficient of friction ($\mu_s$) and wear life (number of sliding cycles) at different PFPE concentrations and at different loading conditions (both sides of the Lub-tape were tested, as indicated).

| Test and Nanocomposite Description | | PFPE weight Percentage in the Composite | Initial coefficient of friction, COF ($\mu_i$) | Steady-state coefficient of friction, COF ($\mu_s$) | Wear Life (Number of Cycles) |
|---|---|---|---|---|---|
| 300 g, 2000 rpm, SU-8 + PFPE Freestanding Lub-tape Film | SU-8 + PFPE Lub-tape Film-Low friction Side | 10% | 0.08 | 0.12 | Failed at 700000 cycles |
| | SU-8 + PFPE Lub-tape Film-High Friction Side (SU-8 alone) | 10% | 0.62 | 0.4 | <2000 |
| 300 g, 1000 rpm, SU-8 + PFPE Free Standing Lub-tape Film | SU-8 + PFPE Lub-tape Film-Low friction Side | 5% | 0.05 | 0.019 | >500000 |
| | SU-8 + PFPE Lub-tape Film-High Friction Side (SU-8 alone) | 5% | 0.56 | 0.38 | <2000 |
| | SU-8 + PFPE Lub-tape Film-Low friction Side | 10% | 0.06 | 0.08 | >500000 |
| | SU-8 + PFPE Lub-tape Film-High Friction Side (SU-8 alone) | 10% | 0.53 | 0.36 | <2000 |

Table 4 shows the initial coefficient of friction ($\mu_i$), the steady-state coefficient of friction ($\mu_s$) and the wear life data for Lub-tape films (conducted at both sides i.e. high friction and low friction sides, respectively) with different PFPE concentrations and at different loads and rotational speeds, respectively. The tribological properties obtained at a normal load of 300 g and a rotational speed of 1000 rpm will be discussed in this section and for other results, Table 4 can be referred. The high friction pristine SU-8 side has shown high friction properties ($\mu_i$: 0.62 and $\mu_s$: 0.4) and low wear life (n<2000) when tested at a normal load of 300 g and at rotational speeds of 1000 rpm and 2000 rpm, respectively. Under the same loading conditions, SU-8+PFPE side has shown very low coefficients of friction ($\mu_i$: 0.08 and $\mu_s$: 0.12) and high wear life (n>500,000). Therefore, the SU-8+PFPE film present on the other side of the tape shows significant improvement in tribological properties (the $\mu_i$ has been reduced by ~8 times, the $\mu_s$ has been reduced by ~3.5 times and the wear life has been improved by >250 times) when compared with the properties of high friction side (pristine SU-8). The high friction side of the Tape can be used to adhere to the surface of interest and apparently the SU8+PFPE layer will be exposed against the counterface material and can reduce the friction and increase the wear life. The PFPE concentration in the composites was increased from 5 wt % to 10 wt % and then the tribological behavior was evaluated. An increase of PFPE concentration from 5 wt % to 10 wt % has shown an improvement in tribological properties by 30-40%. Therefore, the concentration of the PFPE has to be optimized depending on the application requirements and the operating conditions of the Lub-tape once it is placed in the application.

Figure 13:
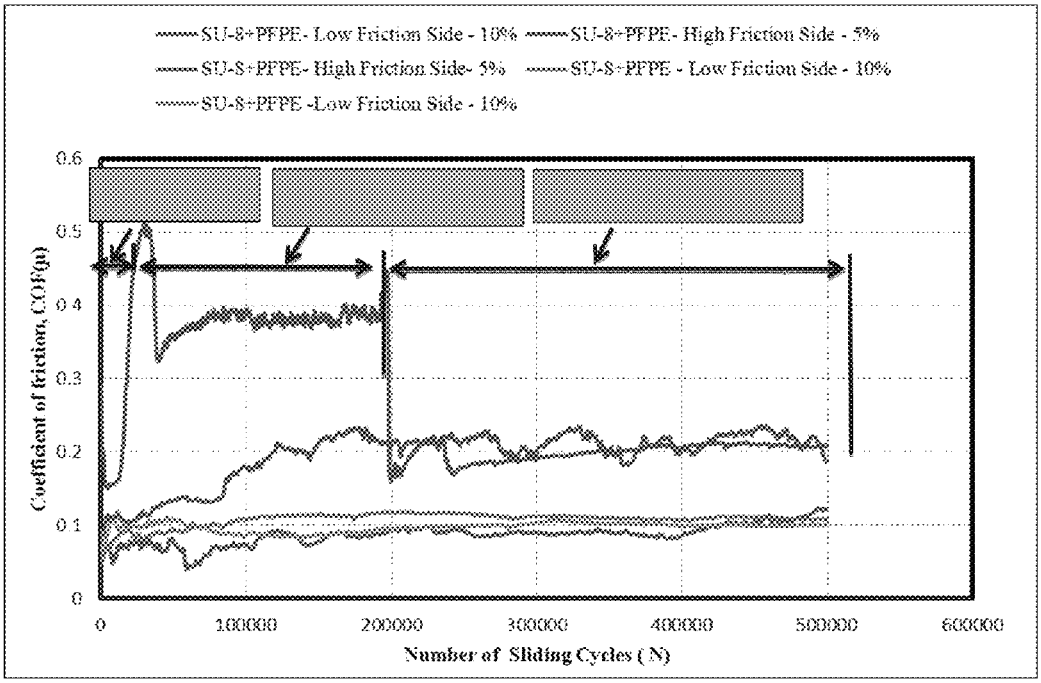
FIG. 13: Coefficient of friction versus number of sliding cycles data for SU-8 Lub-tape tested at both sides of the tape (high friction and low friction sides, respectively) tested against 4 mm diameter $Si_3N_4$ ball at a normal load of 300 g and a sliding speed of 1000 rpm and also at different PFPE concentrations.
Figure 14:
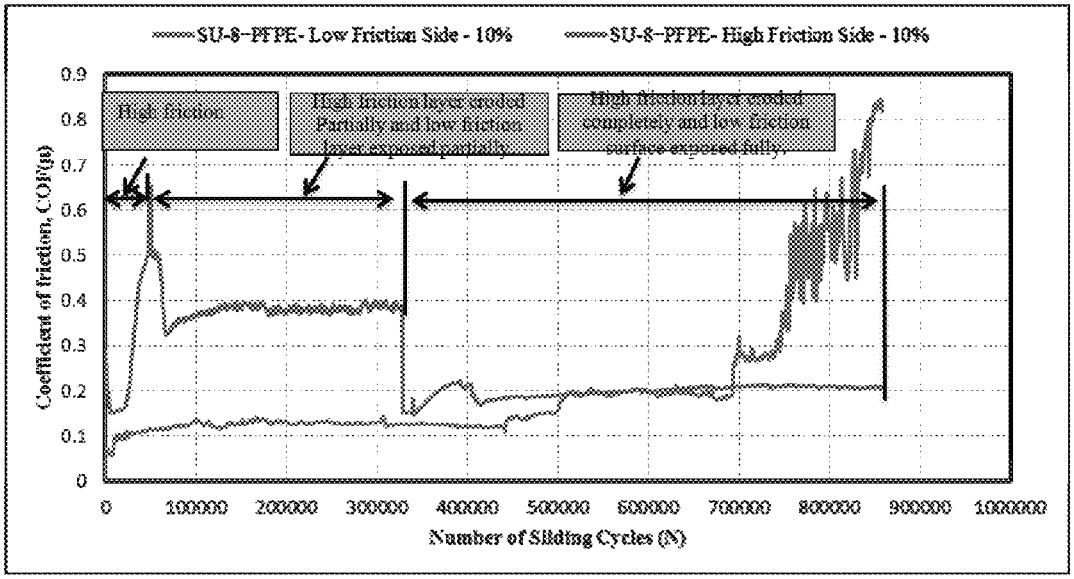
FIG. 14: Coefficient of friction versus number of sliding cycles data for SU-8 Lub-tape tested at both sides of the tape (high friction and low friction sides, respectively) tested against 4 mm diameter $Si_3N_4$ ball at a normal load of 300 g and a sliding speed of 2000 rpm and also at different PFPE concentrations.

FIG. 12-14 shows a photograph of the Lub-tape with description of different layers and coefficient of friction versus number of sliding cycles graph for all the Lub-tapes tested in this experiment, respectively. The tribological properties summarized in Table 4 have been obtained from these graphs.

Figure 15:
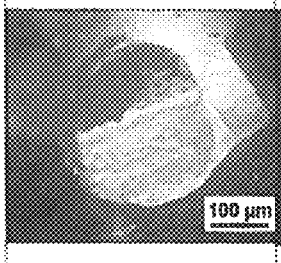
FIG. 15: Optical micrographs of the ball surface after sliding tests, after cleaning the tested ball with acetone and the wear track surface of SU-8 Lub-tape tested against 4 mm diameter $Si_3N_4$ ball at different loading conditions and at different PFPE concentrations.
Figure 15:
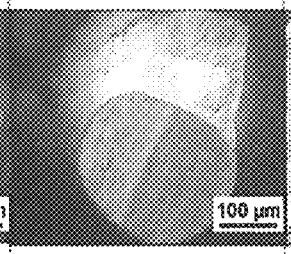
Figure 15:
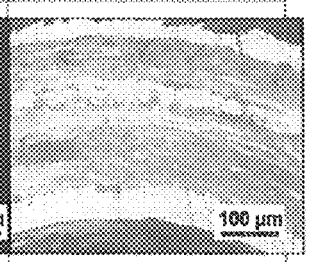
Figure 15:
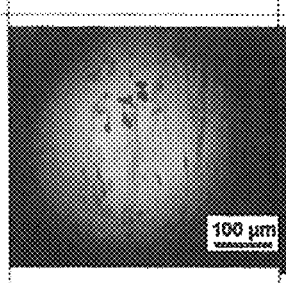
Figure 15:
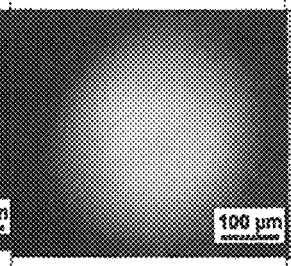
Figure 15:
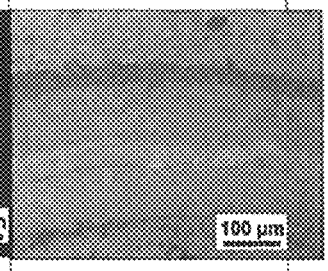
Figure 15:
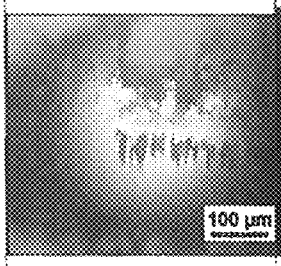
Figure 15:
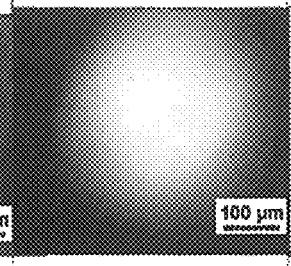
Figure 15:
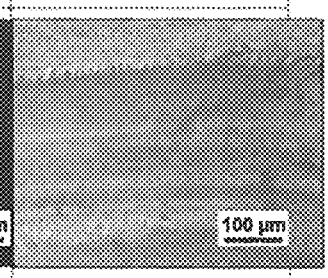

FIG. 15 shows the optical micrographs of the ball surface after sliding tests, the tested balls after cleaning with acetone and the optical images of worn surfaces after appropriate number of cycles. These images qualitatively support the tribological data explained in the preceding paragraphs.

Experiment 4

Evaluation of Other Liquid lubricants

In this experiment, SU-8 based films were formed using SU8+MAC and SU-8+Base oil, in a manner identical, essentially identical, or analogous to that described above for SU-8+PFPE.

Figure 16:
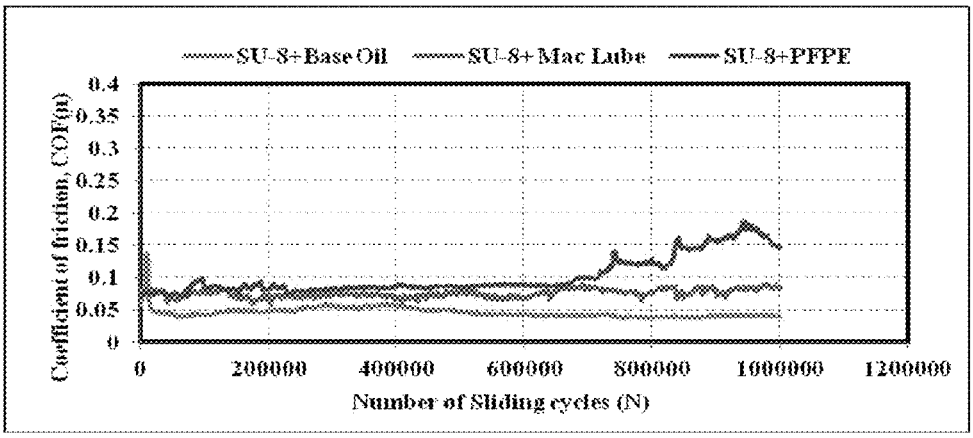
FIG. 16: Coefficient of friction versus number of cycles data for SU-8+Base oil, SU-8+MAC, and SU-8+PFPE coatings on Si obtained from ball-on-disk sliding tests against 4 mm diameter $Si_3N_4$ ball at a normal load of 300 g and a sliding rotation of 2000 rpm. Tests were stopped at 1 million cycles because of the long test duration, as the samples had not failed.

Results:

The tribological behavior of SU-8 based films made using different liquid lubricant formulations can be ascertained from Table 5, and graphically seen from FIG. 16. Blending of various liquid lubricants with SU-8 polymer resulted in essentially or substantially identical or analogous tribological performance with some marginal or insignificant deviation. All three SU-8 based films considered in this experiment have shown essentially identical wear resistance at the tested conditions. The SU-8+Base oil composite has shown lowest coefficient of friction and stable friction behavior throughout the sliding until $10^6$ cycles (at the tested condition) when compared with SU-8+PFPE and SU-8+MAC lube composites.

TABLE 5

Initial coefficient of friction ($\mu_i$), Steady-state coefficient of friction ($\mu_s$) and wear life (number of sliding cycles) of SU-8 nanocomposites with different lubricant blending obtained from sliding tests against 4 mm diameter $Si_3N_4$ ball at a normal load of 300 g and a sliding speed of 2000 rpm. Data reported here is an average value of many repeated tests of above mentioned configuration.

| Test Condition and Nanocomposite (lubricants) Description | | Initial coefficient of friction, COF ($\mu_i$) | Steady- state coefficient of friction, COF ($\mu_s$) | Wear Life (Number of Cycles) |
|---|---|---|---|---|
| 300 g, 2000 rpm, Spin Coated on Si | SU-8 + PFPE | 0.07 | 0.09 | >1000000 |
| | SU-8 + Mac Lube | 0.08 | 0.07 | >1000000 |
| | SU-8 + Base Oil | 0.06 | 0.06 | >1000000 |

REFERENCES

[1] Abgrall, P., Conedera, V., Camon, H., Gue, A-M. and Nguyen, N-T. "SU-8 as a structural material for labs-on-chips and microelectromechanical systems", Electrophoresis 28 (2007) 4539-4551.

[2] Ahn, H.-S., Julthongpiput, D., Kim, D.-I. and Tsukruk, V. V. "Dramatic enhancement of wear stability in oil-enriched polymer gel nanolayers", Wear 255 (2003) 801-807.

[3] Asay, D. B., Dugger, M. T., Ohlhausen, J. A. and Kim, S. H. "Macro- to Nanoscale Wear Prevention via Molecular Adsorption", Langmuir 24 (2008) 155-159. (a).

[4] Asay, D. B., Dugger, M. T. and Kim, S. H. "In-situ Vapor-Phase Lubrication of MEMS", Tribology Letters 29 (2008) 67-74. (b).

[5] Chiamori, H. C., Brown, J. W., Adhiprakasha, E. V., Hantsoo, E. T., Straalsund, J. B., Melosh, N. A. and Pruitt, B. L. "Suspension of nanoparticles in SU-8: Processing and characterization of nanocomposite polymers", Microelectronics Journal 39 (2008) 228-236.

[6] Conradie, E. H. and Moore, D. F. "SU-8 thick photoresist processing as a functional material for MEMS applications", Journal of Micromechanics and Microengineering 12 (2002) 368-374.

[7] de Boer, M. P. and Mayer, T. M. "Tribology of MEMS", MRS Bulletin 04 (2001) 302-304.

[8] Eapen, K. C., Patton, S. T., Smallwood, S. A., Philips, B. S. and Zabinski, J. S. "MEMS Lubricants Based on Bound and Mobile Phases of Hydrocarbon Compounds: Film Deposition and Performance Evaluation", Journal of Microelectromechanical Systems 14 (2005) 954-960.

[9] Henck, S. A. "Lubrication of digital micromirror Devices™", Tribology Letters 3 (1997) 239-247.

[10] Jiguet, S., Bertsch, A., Judelewicz, M., Hofmann, H. and Renaud, P. "SU-8 nanocomposite photoresist with low stress properties for microfabrication applications", Microelectronic Engineering 83 (2006) 1966-1970. (a)

[11] Jiguet, S., Judelewicz, M., Mischler, S., Bertch, A. and Renaud, P. "Effect of filler behavior on nanocomposite SU8 photoresist for moving micro-parts", Microelectronic Engineering 83 (2006) 1273-1276. (b)

[12] Julthongpiput, D., Ahn, H.-S., Sidorenko, A., Kim, D.-I. and Tsukruk, V. V. "Towards self-lubricated nanocoatings", Tribology International 35 (2002) 829-836. (a)

[13] Julthongpiput, D., Ahn, H.-S., Kim, D.-I. and Tsukruk, V. V. "Tribological behavior of grafted polymer gel nanocoatings", Tribology Letters 13 (2002) 35-40. (b)

[14] Kim, S. H., Asay, D. B. and Dugger, M. T. "Nanotribology and MEMS", Nano Today 2 (2007) 22-29.

[15] Knieling, T., Lang, W. and Benecke, W. "Gas phase hydrophobisation of MEMS silicon structures with self-assembling monolayers for avoiding in-use sticking", Sensors and Actuators B 126 (2007) 13-17.

[16] Lee, K. K., Bhushan, B. and Hansford, D. "Nanotribological characterization of fluoropolymer thin films for biomedical micro/nanoelectromechanical system applications", Journal of Vacuum Science and Technology A 23 (2005) 804-810.

[17] Ma, J. Q., Pang, C. J., Mo, Y. F. and Bai, M. W. "Preparation and tribological properties of multiply-alkylated cyclopentane (MAC)-octadecyltrichlorosilane (OTS) double-layer film on silicon", Wear 263 (2007) 1000-1007.

[18] Marinis, T. F. "The Future of Microelectromechanical Systems (MEMS)", Strain 45 (2009) 208-220.

[19] Mionic, M., Jiguat, S., Judelewicz, M., Forro, L. and Magrez, A. "Preparation and characterization of SU8-carbon nanotube composites", Phys. Status Solidi B 246 (2009) 2461-2464.

[20] Mionic, M., Jiguat, S., Judelewicz, M., Karimi, A., Forro, L. and Magrez, A. "Study of the mechanical response of carbon nanotubes-SU8 composites by nanoindentation", Phys. Status Solidi B 247 (2010) 3072-3075.

[21] Patton, S. T., Eapen, K. C., Zabinski, J. S., Sanders, J. H. and Voevodin, A. A. "Lubrication of microelectromechanical systems radio frequency switch contacts using self-assembled monolayers", Journal of Applied Physics 102 (2007) 024903.

[22] Patton, S. T., Slocik, J. M., Campbell, A., Hu, J., Naik, R. R. and Voevodin, A. A. "Bimetallic nanoparticles for surface modification and lubrication of MEMS switch contacts", Nanotechnology 19 (2008) 405705.

[23] Prasad, S. V., Scharf, T. W., Kotula, P. G., Michael, J. R. and Christenson, T. R. "Application of Diamond-Like Nanocomposite Tribological Coatings on LIGA Microsystem Parts", Journal of Microelectromechanical Systems 18 (2009) 695-704.

[24] Puukilainen, E. and Pakkanen, T. A. "Modification of Surface Properties of Polyethylene by Perfluoropolyether Blending", Journal of Polymer Science: Part b: Polymer Physics 43 (2005) 2252-2258.

[25] Puukilainen, E., Koponen, H.-K., Xiao, Z., Suvanto, S. and Pakkanen, T. A. "Nanostructured and chemically modified hydrophobic polyolefin surfaces", Colloids and Surfaces A: Physicochemical Engineering Aspects 287 (2006) 175-181.

[26] Puukilainen, E., Saarenpaa, H. and Pakkanen, T. A. "Compression-Molded, Lubricant-Treated UHMWPE Composites", Journal of Applied Polymer Science 104 (2007) 1762-1768.

[27] Satyanarayana, N. and Sinha, S. K. "Tribology of PFPE overcoated self-assembled monolayers deposited on Si surface", Journal of Physics D: Applied Physics 38 (2005) 3512-3522.

[28] Satyanarayana, N., Sinha, S. K. and Lim, S-C. "Highly wear resistant chemisorbed polar ultra-high-molecular-weight polyethylene thin film on Si surface for microsystem applications", Journal of Materials Research 24 (2009) 3331-3337.

[29] Scharf, T. W., Prasad, S. V., Dugger, M. T., Kotula, P. G., Goeke, R. S. and Grubbs, R. K. "Growth, structure, and tribological behavior of atomic layer-deposited tungsten disulphide solid lubricant coatings with applications to MEMS", Acta Materialia 54 (2006) 4731-4743.

[30] Sidorenko, A., Ahn, H-S., Kim, D-I., Yang, H. and Tsukruk, V. V. "Wear stability of polymer nanocomposite coatings with trilayer architecture", Wear 252 (2002) 946-955. (a)

[31] Sidorenko, A., Julthongpiput, D., Luzinov, I. and Tsukruk, V. V. "Oily nanocoatings", Tribology Letters 12 (2002) 101-104. (b)

[32] Singh, R. A., Satyanarayana, N., Kustandi, T. S. and Sinha, S. K. "Tribo-functionalizing Si and SU8 materials by surface modification for application in MEMS/NEMS actuator-based devices", Journal of Physics D: Applied Physics 44 (2011) 015301.

[33] Singh, R. A., Satyanarayana, N. and Sinha, S. K. "Surface chemical modification for exceptional wear life of MEMS materials", AIP Advances 1 (2011) 042141.

[34] Voigt, A., Heinrich, M., Martin, C., Liobera, A., Gruetzner, G. and Perez-Murano, F. "Improved properties of epoxy nanocomposites for specific applications in the field of MEMS/NEMS", Microelectronic Engineering 84 (2007) 1075-1079.

Aspects of particular embodiments of the present disclosure address at least one aspect, problem, limitation, and/or disadvantage associated with existing compositions, coatings, films, structures, or laminates. While features, aspects, and/or advantages associated with certain embodiments have been described in the disclosure, other embodiments may also exhibit such features, aspects, and/or advantages, and not all embodiments need necessarily exhibit such features, aspects, and/or advantages to fall within the scope of the disclosure. It will be appreciated by a person of ordinary skill in the art that several of the above-disclosed systems, components, processes, or alternatives thereof, may be desirably combined into other different systems, components, processes, and/or applications. In addition, various modifications, alterations, and/or improvements may be made to various embodiments that are disclosed by a person of ordinary skill in the art within the scope and spirit of the present disclosure. Such modifications, alterations, and/or improvements are encompassed by the following claims.

The invention claimed is:

1. A composition comprising:

at least one polymer;

at least one liquid lubricant; and at least one inorganic filler material, wherein the composition is a substantially homogeneous mixture that exists in a substantially liquid form, and which includes approximately 70-99.5% of the at least one polymer, and wherein the at least one inorganic filler material includes at least one nanomaterial.

2. The composition of claim 1, wherein the composition includes approximately 70%-99.5% of the at least one polymer, approximately 0.1%-29.9% of the at least one liquid lubricant, and at least approximately 0.4%-29.9% of the at least one nanomaterial, wherein the percentage of the at least one polymer, the percentage of the at least one liquid lubricant, and the percentage of the at least one nanomaterial are selected to yield 100% of the composition.

3. The composition of claim 1, wherein the composition includes approximately 80%-98% of the at least one polymer, approximately 1%-10% of the at least one liquid lubricant, and approximately 1%-10% of the at least one nanomaterial, wherein the percentage of the at least one polymer, the percentage of the at least one liquid lubricant, and the percentage of the at least one nanomaterial are selected to yield 100% of the composition.

4. The composition of claim 1, wherein the at least one polymer comprises one of PMMA and PDMS.

5. The composition of claim 1, wherein the at least one polymer comprises a photosensitive polymer.

6. The composition of claim 1, wherein the at least one polymer comprises one of SU-8, KMPR, and JSR THB 151N photoresist.

7. The composition of claim 1, wherein the at least one liquid lubricant comprises one of PFPE, mineral oil, base oil, multiply alkylated cyclopentane, and a plant-based oil.

8. The composition of claim 1, wherein the at least one nanomaterial comprises one of graphite, a fullerene, graphene, $SiO_2$, $MoS_2$, $WS_2$, $TiO_2$, Ultra High Molecular Weight Polyethylene (UHMWPE), Polytetrafluoroethylene (PTFE), Polyether ether ketone (PEEK), and a metamaterial.

9. The composition of claim 1, wherein the composition exhibits enhanced tribological and mechanical properties compared to the at least one polymer in isolation.

10. The composition of claim 1, wherein the composition exhibits a coefficient of friction reduction of at least approximately 50% compared to the at least one polymer in isolation.

11. The composition of claim 1, wherein the composition exhibits a wear life increase of at least approximately 100% compared to the at least one polymer in isolation.

12. The composition of claim 1, wherein the composition exhibits a wear life increase of at least approximately an order of magnitude compared to the at least one polymer in isolation.

13. The composition of claim 1, wherein the composition exhibits an elastic modulus increase of at least approximately 10% compared to the at least one polymer in isolation.

14. The composition of claim 1, wherein the composition exhibits a hardness increase of at least approximately 10% compared to the at least one polymer in isolation.

15. The composition of claim 1, wherein the presence of the nanomaterial significantly increases at least one of hardness and elastic modulus of the composition.

16. The composition of claim 1, wherein the nanomaterial includes a first nanomaterial providing increased hardness, and a second nanomaterial providing increased elastic modulus.

17. The composition of claim 1, wherein the composition exists in a substantially liquid form suitable for spin coating or dip coating application to a substrate.

18. The composition of claim 17, wherein the composition exists as a cured or partially solid film carried by the substrate.

* * * * *